US012778277B2

(12) United States Patent
Gerhardt et al.

(10) Patent No.: US 12,778,277 B2
(45) Date of Patent: Nov. 3, 2026

(54) ORAL CARE SYSTEM WITH SANITIZATION FUNCTION

(71) Applicant: KONINKLIJKE PHILIPS N.V., Eindhoven (NL)

(72) Inventors: Lutz Christian Gerhardt, Eindhoven (NL); Priscilla Brandao Silva, Eindhoven (NL); Nicolaas Petrus Willard, Valkenswaard (NL); Mark Thomas Johnson, Arendonk (BE); Lucas Petrus Henricus Scheffers, Utrecht (NL); Joyce Van Zanten, Waalre (NL); Cornelis Reinder Ronda, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 539 days.

(21) Appl. No.: 18/027,650

(22) PCT Filed: Sep. 14, 2021

(86) PCT No.: PCT/EP2021/075164

§ 371 (c)(1),
(2) Date: Mar. 22, 2023

(87) PCT Pub. No.: WO2022/063626

PCT Pub. Date: Mar. 31, 2022

(65) Prior Publication Data

US 2023/0404252 A1 Dec. 21, 2023

(30) Foreign Application Priority Data

Sep. 22, 2020 (EP) ..... 20197522

(51) Int. Cl.
*A46B 17/06* (2006.01)
*A46B 17/04* (2006.01)

(52) U.S. Cl.
CPC ..... *A46B 17/065* (2013.01); *A46B 17/04* (2013.01); *A46B 2200/1066* (2013.01)

(58) Field of Classification Search
CPC ..... A46B 17/04; A46B 17/06; A46B 17/065; A46B 15/002; A46B 15/003; A46B 15/0034; A46B 2200/1066
See application file for complete search history.

(56) References Cited

U.S. PATENT DOCUMENTS 5,340,200 A 8/1994 Erickson
10,201,701 B2 2/2019 Levi
(Continued)

FOREIGN PATENT DOCUMENTS

CN 108338498 A * 7/2018 ..... A46B 17/06
CN 211381903 U 9/2020
(Continued)

OTHER PUBLICATIONS

International Search Report and Written Opinion Dated Dec. 22, 2021 For International Application No. PCT/EP2021/075164 Filed Sep. 14, 2021.
(Continued)

*Primary Examiner* — Laura C Guidotti

(57) ABSTRACT

An oral care system (10) comprises an oral care device (12). The oral care device is designed to either comprise or attach to a cleaning or treatment portion (14), e.g. a brush head or mouthpiece. The oral care device thus has a cleaning or treatment function. The oral care device is further provided with an electromagnetic (EM) field or radiation generator (22) adapted to generate and emit radio or microwave frequency electromagnetic energy in a space around an emitter arrangement (24) (sanitization area) used to emit the radiation or field. The EM emissions are configured to have electromagnetic properties suitable for heating water or water-containing fluid located within the sanitization area
(Continued)

(34). This allows for a sanitization or disinfection function in a dedicated mode, wherein the EM emissions of the EM generator causes heating to a temperature of at least 50° C., preferably at least 70° C., of water on any surfaces of the cleaning or treatment portion located within the sanitization area, the heating having a sanitization or disinfection effect.

14 Claims, 9 Drawing Sheets

(56) References Cited

U.S. PATENT DOCUMENTS

| | | | |
|---|---|---|---|
| 2006/0281042 | A1 | 12/2006 | Rizoiu et al. |
| 2008/0060153 | A1 | 3/2008 | Jansheski |
| 2008/0060829 | A1 | 3/2008 | Jansheski |
| 2008/0288007 | A1 | 11/2008 | Malak |

FOREIGN PATENT DOCUMENTS

| | | | | | |
|---|---|---|---|---|---|
| EP | 3386346 | B1 | * | 7/2019 | ..... A46B 15/00 |
| JP | 2014-30602 | A | * | 2/2014 | ..... A61C 17/00 |
| KR | 20180006567 | A | | 1/2018 | |
| KR | 20190080003 | A | | 7/2019 | |
| WO | 2017216606 | A1 | | 12/2017 | |
| WO | 2021239549 | A1 | | 12/2021 | |
| WO | 2021239554 | A1 | | 12/2021 | |

OTHER PUBLICATIONS

Gujjari et al., "Comparative evaluation of ultraviolet and microwave sanitization techniques for toothbrush decontamination"; (2011); https://www.ncbi.nlm.nih.gov/pmc/articles/PMC3894078/.

Young et al., "Microwave Sterilization of Nitrous Oxide Nasal Hoods Contaminated With Virus", (1985) https://pubmed.ncbi.nlm.nih.gov/2999676/ University of Oklahoma College of Dentistry.

Andryieuski et al, "Water: Promising Opportunities For Tunable All-dielectric Electromagnetic Metamaterials". Aug. 27, 2015, Scientific Reports 5:13535.

Craig, "5 Best UV Toothbrush Sanitizers (Plus Top Electric Toothbrushes with UV Sanitizers)", OralCareHome. http://www.oralcarehome.com/best-uv-toothbrush-sanitizers/.

Braun, "How Clean Is Your Toothbrush?" Health, Apr. 20, 2015 Toothbrush microwave cleaning instructions https://www.menshealth.com/health/a19539317/how-clean-your-toothbrush/.

* cited by examiner

ORAL CARE SYSTEM WITH SANITIZATION FUNCTION

This application is the U.S. National Phase application under 35 U.S.C. § 371 of International Application No. PCT/EP2021/075164, filed on Sep. 14, 2021, which claims the benefit of EP application Ser. No. 20197522.4, filed Sep. 22, 2020. These applications are hereby incorporated by reference herein.

FIELD OF THE INVENTION

The present invention relates to an oral care system including an oral care device, and particularly to an oral care system having a sanitization function.

BACKGROUND OF THE INVENTION

WO2017216606A1 and US2008288007A1 disclose prior art oral care devices.

Sanitization is a process that aims at killing or deactivating bacteria and other microorganisms on surfaces. Sanitization is a useful function for oral care devices which include parts placed in the mouth, where introduction of microorganisms could have health effects. Examples of oral care devices include powered toothbrushes, brushing mouthpiece devices, oral irrigators, and powered flossers. Each includes at least a portion (a cleaning and/or treatment portion) received in the mouth during use (e.g. brush head, or a mouthpiece portion).

Existing sanitization techniques for mouth-received portions of oral care devices often have low efficacy or are cumbersome and inconvenient. One example includes use of UV light. This is often not effective or efficient due to the shading effect caused by parts of the oral care device, such as the bristle field, blocking irradiation of some surfaces. It also typically requires long exposure times (up to 15 minutes) or, alternatively, very high intensities which may be unsafe or impractical. Another limitation of UV light sanitization, particularly for brush heads or brushing mouthpieces, is that the light mainly interacts with the surfaces of the bristles, and fails to penetrate to surfaces at the base of the platen between bristles. In addition, radiation which does reach these surfaces may have low intensity due to build-up of toothpaste residue, resulting in absorption or reflection of UV radiation which makes UV light sanitization ineffective at these locations.

Thus, microorganisms for instance at the base of the bristle field or in between bristles are not reached by UV light. Insufficient sanitization of these areas can lead to mold formation.

Furthermore, existing sanitization solutions typically require use of larger external accessories to perform the sanitization procedure, for example dedicated cleaning stations. These require provision of their own source of power, and possibly of cleaning agents, if they are to actively sanitize the oral cleaning and/or treatment portion of the oral care device.

Therefore, it would be desirable to achieve more effective and efficient cleaning and sanitization procedures for mouth-received parts of oral care devices.

SUMMARY OF THE INVENTION

The invention is defined by the independent claims. The dependent claims define advantageous embodiments.

According to examples in accordance with an aspect of the invention, there is provided an oral care system, comprising an oral care device, the device either comprising or being operably coupleable to a cleaning and/or treatment portion for being at least partially received in an oral cavity of a user for performing a cleaning or treatment function.

The oral care device comprises a signal generator operable to generate radiofrequency (RF) and/or microwave frequency electromagnetic radiation (and/or an alternating electromagnetic field) when said generator is operatively coupled to an emitter arrangement (e.g. a conductor arrangement or an electroactive material or a metamaterial arrangement).

The signal generator is selectively operable in a sanitization mode in which the generator is adapted to generate signals for causing a connected emitter arrangement to generate radiofrequency (RF) and/or microwave frequency electromagnetic radiation in a sanitization area around the emitter arrangement, the radiation suitable for causing heating of (at least) water, or water-containing fluid, in contact with any exposed surfaces of the cleaning or treatment portion located in the sanitization area. This is for performing sanitization of the cleaning and/or treatment portion.

The radiation is preferably suitable for causing heating of water in contact with any exposed surfaces of the cleaning or treatment portion to a temperature of at least 50° C., preferably at least 70° C.

It may additionally be suitable for heating other liquids or gasses in some examples such as Ethylene glycol, Ethanol, Methanol, Acetic acid. These might be included in dedicated cleaning solvents for example, for use during sanitization of the cleaning and/or treatment portion.

In the context of the present disclosure, the phase 'suitable for heating of water' may mean suitable for heating of water or water-containing substances (such as for example toothpaste or toothpaste slurry, saliva, mouthwash or a combination thereof). More generally, microwave radiation may be suitable for heating any substance which contains polar molecules.

Embodiments of the present invention are based on providing sanitization of a cleaning or treatment portion (CTP) of an oral care device (e.g. a brush head of a toothbrush, or a brushing mouthpiece unit) by generating electromagnetic (EM) energy or radiation within a space containing the oral cleaning or treatment portion at a frequency suitable for causing heating and optionally evaporation (steaming) of water. At least any water-containing fluid (liquid or gas) in contact with surfaces of the CTP will be heated. This can be residual fluid left after oral cleaning or treatment, or the CTP may be submerged in fluid during sanitization. It may be toothpaste slurry for example.

The control parameters may optionally be set so that the water is heated to a desired threshold temperature, and preferably for a desired threshold time, for thereby sanitizing the CTP. For example, generating EM energy to heat the water to at least 70° C. for at least 10 seconds has been shown to be sufficient for sanitization, killing 99.9% of bacteria. This can be based for example on an assumed volume of water which will be heated, e.g. approximately 1 ml of water, starting at 15-25° C. Given knowledge of the emission characteristics and structural configuration of the emitter arrangement, it is possible to provide a control program which achieves a desired heating level for a desired time.

In some examples, the control parameters can be set so that the material of the cleaning or treatment portion surfaces exposed to the EM radiation is itself heated to a desired threshold temperature, and preferably for a desired threshold time, for thereby sanitizing the CTP. For example, the exposed surfaces of the cleaning and/or treatment portion in the sanitization area may be heated to at least 50-70° C.

It is known that heating of water requires application of EM radiation or energy of a particular range of frequencies, suitable for efficiently interacting with the water molecule dipoles to cause the dipoles to oscillate. For example, the generator may be adapted in the sanitization mode to drive the emitter arrangement to generate EM radiation at a frequency of between 300 MHz-300 GHz, for example between 2-300 GHz, for example between 2-30 GHz.

The sanitization area simply means an area or space or region which is exposed to electromagnetic radiation emitted by the emitter arrangement when driven by the generator. It is thus a space within which water or other materials are subject to heating, and thus where sanitization may occur.

There are different options for the location and configuration of the emitter arrangement. The emitter arrangement may be located in or on the cleaning or treatment portion. This means that the sanitization area around the emitter arrangement inherently encompasses a section of the CTP. The emitter arrangement can be located at, within, or in vicinity of an area intended to be sanitized in use. The sanitization mode can be performed when the CTP is outside of the oral cavity.

Alternatively, the emitter arrangement may be located in a separate unit, e.g. a sanitization station, which may define a sanitization area, e.g. a cavity, within which the cleaning or treatment portion is receivable.

In both cases, the oral care device comprises the signal generator, and is adapted to electrically couple to the emitter arrangement, at least during sanitization. For example, the device may dock electrically with a separate sanitization station. Having the generator in the oral care device avoids the need for active electronic components in the separate sanitization unit. Only passive components are needed (the emitter arrangement). An oral care device may typically already include a local power source, e.g. for generation of oscillation motion. This may be efficiently harnessed for providing the dual function of powering EM field or radiation generation.

Alternatively, in cases in which the emitter arrangement is included in or on the cleaning or treatment portion (CTP), the emitter arrangement is arranged to be electrically coupled with the generator when the cleaning or treatment portion is coupled to the device, or may be permanently electrically connected thereto. Hence, here the emitter arrangement is carried by the CTP. Thus, the sanitization area corresponds to an area which encompasses at least the section of the CTP which comprises the conductive elements. The oral care system may comprise the CTP, or the CTP can be an auxiliary unit.

In accordance with one or more embodiments, the signal generator may be further selectively operable in a cleaning or treatment mode in which the generator is adapted to generate signals for causing a connected emitter arrangement to generate an electromagnetic field or radiation for performing an oral cleaning or treatment function. Said function is for being performed when the emitter arrangement is received in the oral cavity.

Thus, in this embodiment, the oral care device comprises an integrated electromagnetic cleaning or treatment function designed to drive an emitter arrangement in the cleaning or treatment portion to generate an EM field or EM radiation to perform the cleaning or treatment.

In this case, optionally the same emitter arrangement and signal generator are harnessed for the dual function of also performing the sanitization action.

In the cleaning or treatment mode, the generator may cause generation of an EM field or EM radiation of a lower electromagnetic frequency than in the sanitization mode. It may also generate a field or emissions of lower electromagnetic power, and/or lower power density.

For example, a sanitization mode may be operated with EM emissions in the order of high hundreds of MHz or GHz (e.g. 0.3-300 GHz), whereas the cleaning or treatment mode may generate EM emissions in the order of between 1-300 MHz, for example between 1-100 MHz. For example, in the cleaning or treatment mode, the generator may drive the emitter arrangement to generate EM radiation at a frequency of less than 100 MHz, for example, less than 50 MHz, for example between 1-20 MHz, for example between 1-10 MHz.

In accordance with one or more embodiments, in the sanitization mode, the generator may be adapted or controlled to generate signals for causing the emitter arrangement to generate an EM field or EM radiation having an average power of at least 10-20 W, and for a period of at least 10-20 seconds. This can be done by generating drive signals for causing the emitter arrangement to generate electromagnetic radiation, the drive signals having an average power of at least 10-20 W, and the signals being generated for a period of at least 10-20 seconds. This has been found to be sufficient to heat small amounts of water, as may be found on surfaces of an oral care device, to a temperature of at least 70° C. The generator may further be adapted to subsequently generate EM radiation having an average power of 10-20 W for a further 10-20 seconds. This has been found to be sufficient to maintain the water at said temperature of at least 70° C. for 10-20 seconds.

In accordance with one or more embodiments, the sanitization mode may include a sanitization control program in which an electromagnetic field or radiation is generated with a suitable power and for a suitable time period for heating a pre-defined minimum volume of water, e.g. at least 1 ml, to a temperature of at least 70° C., and to maintain the temperature at or above 70° C. for at least 10 seconds.

In accordance with one or more embodiments, the oral care device may further comprise a mechanical actuator for providing a source of mechanical movement. The actuator is arranged so that the mechanical movement is mechanically coupled to the cleaning or treatment portion, or adapted to be mechanically coupled thereto when said portion is operatively connected. Preferably the mechanical actuator is controlled to be active during the sanitization mode.

This provides for combined mechanical cleaning (agitation) and electromagnetic sanitization of the cleaning or treatment portion. Mechanical cleaning may remove larger particles of debris (from e.g. a bristle field of a toothbrush or mouthpiece portion, or from the emitter arrangement), while the emitted EM energy can kill or deactivate microorganisms.

In accordance with one or more embodiments, oral care system may comprise the emitter arrangement, and may further comprise an electromagnetic shield unit configurable in a deployed position in which the shield unit is arranged in a defined spatial relationship with respect to the sanitization area around the emitter arrangement and is adapted to at least partially inhibit escape of electromagnetic radiation or energy from the sanitization area.

The shield unit enhances efficiency of the heating of the water, and therefore reduces the time and energy requirements for performing the sanitization. It also may provide a safety function, protecting a user from exposure to the EM radiation.

The shield unit is adapted to at least partially contain electromagnetic radiation or energy in the sanitization area. It may redirect or concentrate the radiation through reflection in some cases.

It may comprise a plurality of shielding walls arranged around and facing toward the sanitization area.

The shield unit may comprise one or more electromagnetic-reflective elements or surfaces adapted to at least partially reflect the electromagnetic energy generated by the emitter arrangement in the sanitization mode, for use in at least partially containing said energy in the sanitization area when the shield unit is placed in the deployed configuration. When in the deployed configuration, it may reflect the EM energy back toward the emitters, or otherwise toward the sanitization area.

The reflective surfaces or elements should be reflective of the radiation at the frequency generated by the generator in the sanitization mode.

Preferably, the EM reflective surfaces or elements are configured to reflect at least 20% of any electromagnetic energy (generated by the sanitization mode) incident thereupon, for example at least 50%, for example at least 60%, for example at least 80%.

The reflective surfaces may be integral to the shield unit. For example, they may be intrinsically provided by the material of the shield unit itself, for example if the shield unit is formed of an EM reflective material.

In accordance with one or more embodiments, the oral care system may comprise the cleaning or treatment portion, and wherein the shield unit comprises a cap or cover defining an internal cavity or space, and arranged in the deployed configuration to fit over at least a section of the cleaning or treatment portion with said portion at least partially received in the cavity.

The section of the cleaning and/or treatment portion which comprises the emitter arrangement is received in the cavity when the shield unit is in the deployed configuration.

The cap or cover is arranged to at least partially contain EM emissions generated by the emitter arrangement within the cavity.

In accordance with one or more embodiments, the total unoccupied volume of the cavity when the cover or cap is deployed over the at least section of the CTP may be between 1 $cm^3$ and 10 $cm^3$. The unoccupied volume may form a fluid receiving space which may be fully or partially filled with fluid-to-be-heated during operation. The sanitization mode may include a sanitization control program configured for heating a volume of water which fills the total unoccupied space to at least 50-70° C., and maintains said temperature for between 10-20 seconds. This may be based on an assumption of water starting at room temperature, e.g. between 15-25° C.

In advantageous examples, the sanitization control program may be configured for causing heating of all exposed surfaces of the cleaning or treatment portion within the cover or cap, when deployed, to at least 50-70° C. This can be achieved inherently through the heating of the water in contact with said surfaces, or may additionally be achieved through forming the surfaces of a material which is susceptible to heating by the electromagnetic emissions.

By way of one example, the oral care device may be a toothbrush and the cap may be designed to mount over the platen of the brush head, where the platen carries the emitter arrangement and a bristle field. By way of further example, the oral care device may be a toothbrush and wherein the emitter arrangement is integrated in a handle portion of the device and arranged to extend from the handle to a location adjacent the brush head. The cap may mount over the brush head and emitter arrangement.

In accordance with one or more embodiments the shield unit may be physically separable from the oral care device. In a non-deployed configuration, it may be separated from the oral care device. In a deployed configuration it may be mechanically mounted or connected to the oral care device. In this set of one or more embodiments, the oral care system may comprise the cleaning or treatment portion and wherein the cleaning or treatment portion comprises the emitter arrangement.

In accordance with one or more embodiments, the shield unit may be adapted to be mechanically moveable (manually or electronically) between a non-deployed configuration and a deployed configuration, the shield unit being mechanically connected or mounted to the oral care device in both positions, and wherein, in the deployed configuration, the shield unit is arranged at least partially covering or facing the sanitization area (e.g. a section of the cleaning or treatment portion), and, in the non-deployed configuration, the shield unit is in a different position. The different position may have the shield unit in a retracted configuration, wherein it is not covering or facing the sanitization area.

In this set of one or more embodiments, the oral care system may comprise the cleaning or treatment portion and wherein the cleaning or treatment portion comprises the emitter arrangement. Thus, in this case, in the deployed configuration, the shield unit at least partially covers or faces an area containing at least a section of the cleaning or treatment portion, e.g. a head of a toothbrush.

For instance, in one set of examples, the oral care device may have a body portion having an operative end and a handle end. The oral cleaning or treatment portion may be adapted to be connectable to the operative end. The shield unit may be adapted to be slidable along the body portion of the oral care device between the operative end and the handle end.

In accordance with one or more embodiments, the oral care system may further comprise a cover unit being configurable in a deployed configuration in which the cover unit is arranged to enclose or surround the sanitization area to at least partially restrict escape of heat, for encouraging steam generation in the sanitization area/volume, and having a pressure relief opening to permit controlled escape of steam.

The cover unit is reversibly positionable in the deployed configuration, e.g. removably mountable to the CTP.

The shield unit may be a cover or cap arranged to fit over a portion of the cleaning and/or treatment portion for example. It may for example surround and enclose at least a portion of the cleaning and/or treatment portion.

It may be arranged to fluidly seal around the sanitization area, and possibly a section of the cleaning or treatment portion, apart from the pressure relief escape or opening.

The cover unit may comprise a silicone or rubber balloon or cap, by way of two non-limiting examples.

Optionally, the cover unit may also be adapted to at least partially prevent escape of EM energy, e.g. by comprising EM reflective surfaces or elements.

In accordance with one or more embodiments, generator and emitter arrangement may form a generation circuit, and wherein the oral care device further comprises a sensing module, arranged to sense electrical characteristics of the generation circuit, and adapted to detect:

a moisture presence in the sanitization area based on electrical characteristics of the generation circuit; and/or a temperature within the sanitization area based on electrical characteristics of the generation circuit.

Alternatively, a controller may detect the moisture presence and/or temperature based on an output from the sensing module.

Moisture detection may be particularly useful for application in combination with the steam-generating embodiment discussed above. For example, the moisture detection may be used to detect whether steam is present within the sanitization area/volume. This allows monitoring progress of a sanitization cycle of the device, which may comprise converting fluid/water into steam, and escape of the steam, leaving the area (volume) free of moisture. An end of the steam generating or steam sanitization cycle can therefore be detected when the moisture level is below a defined moisture threshold.

It may additionally or alternatively be used to detect when the sanitization area is dry. This indicates that sanitization is complete.

Detecting temperature also allows for monitoring progress of a sanitization cycle of the device. The operation of the EM generator can be optionally be controlled based on the sensing to regulate the temperature or to guide the sanitization area through an intended sanitization cycle.

For example, according to one or more embodiments, the sensing module mentioned above is provided arranged to sense electrical characteristics of the generation circuit, and adapted to detect a temperature within the sanitization area based on electrical characteristics of the generation circuit. The oral care system may further comprise a controller adapted to implement a sanitization control program comprising heating of fluid in the sanitization area to a temperature of at least 50-70° C., and maintaining the fluid at said temperature for at least 10-20 seconds, wherein the controller is arranged to receive a temperature sensing signal from the sensing module for use in implementing the control program (i.e. for sensing when the minimum temperature has been reached) and for regulating the EM output of the generator circuit to maintain the temperature for the time window of at least 10-20 seconds.

In accordance with one or more embodiments, the generator and the emitter arrangement form a generation circuit, and wherein the oral care device further comprises a sensing module, arranged to sense electrical characteristics of the generation circuit, and wherein the shield unit comprises one or more electromagnetic-reflective surfaces or elements adapted to at least partially reflect the electromagnetic field or radiation generated by the emitter arrangement, and wherein the sensing module is adapted to detect placement of the shield unit in the deployed configuration based on the electrical characteristics.

Alternatively, a controller may detect the placement based on an output from the sensing module. The sensing module or controller may compare the detected signal characteristics with a reference signal associated with correct placement of the shield unit. The sensing module or a controller may detect a defined change in one or more electrical characteristics exceeding a threshold amount or matching a defined electrical signature associated with cap placement.

In accordance with one or more embodiments, oral care device may comprise a handle or body portion for a powered toothbrush or a mouthpiece.

Another aspect of the invention provides a cleaning or treatment portion comprising:

cleaning or treatment elements for performing a cleaning or treatment function in an oral cavity of a user; and an emitter arrangement operable to generate radiofrequency (RF) and/or microwave frequency electromagnetic radiation when said emitter arrangement is operatively coupled to a signal generator, wherein the cleaning or treatment portion is selectively operable in a sanitization mode in which the radiation generated by the emitter arrangement is suitable for causing heating to a temperature of at least 50° C., preferably at least 70° C., of water in contact with any exposed surfaces of the cleaning or treatment portion located in a sanitization area around the emitter arrangement for performing sanitization of the cleaning or treatment portion.

Examples in accordance with a further aspect of the invention provide a method for sanitizing at least a cleaning or treatment portion of an oral care device, wherein the cleaning or treatment portion is for being received in an oral cavity or a user for performing a cleaning or treatment function, the method comprising generating signals using a signal generator for causing a connected emitter arrangement to generate radiofrequency and/or microwave frequency electromagnetic radiation in a sanitization area around the emitter arrangement, the radiation suitable for causing heating of water present on any exposed surfaces of the cleaning or treatment portion located in the sanitization area.

The radiation is preferably suitable for causing heating of water present on any exposed surfaces of the cleaning or treatment portion to a temperature of at least 50° C., preferably at least 70° C.

Embodiments of the cleaning or treatment portion and the method match the above embodiments of the system.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
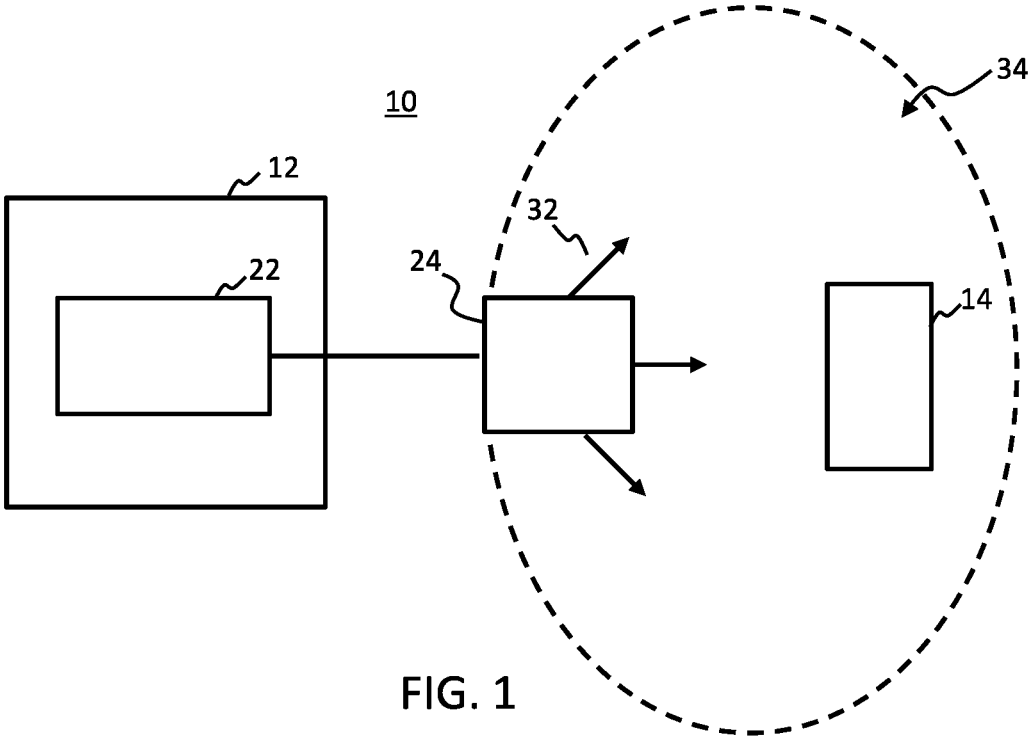
FIG. 1 schematically shows components of an example oral care system.

The invention will be described with reference to the Figures.

It should be understood that the detailed description and specific examples, while indicating exemplary embodiments of the device, systems and methods, are intended for purposes of illustration only and are not intended to limit the scope of the invention. These and other features, aspects, and advantages of the device, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides an oral care system with an oral care device. The oral care device is designed to either comprise or attach to a cleaning or treatment portion for performing a cleaning or treatment function when received in the mouth, e.g. a brush head or mouthpiece. The oral care device thus has a cleaning or treatment function during normal use. The oral care device is further provided with an electromagnetic (EM) field or radiation generator adapted to generate and emit radio or microwave frequency electromagnetic energy in a space or volume ("sanitization area") around an emitter arrangement used to emit the radiation or field. The EM emissions are configured to have electromagnetic properties suitable for heating at least water located within the sanitization area. This allows for a sanitization function in a dedicated mode, wherein the EM emissions of the EM generator causes heating of water on or in contact with any surfaces of the cleaning or treatment portion located within the sanitization area, the heating having a sanitization effect.

For instance, the water can be heated to at least 50-70° C. for at least 10-20 s in some examples. During sanitization, the cleaning or treatment portion can be brought into the sanitization area, in cases where the emitter arrangement is in a separate unit from the oral care device (but e.g. electrically docked with it). Alternatively, the emitter arrangement may be comprised in the cleaning or treatment portion itself so that the sanitization area around the emitter arrangement inherently encompasses surfaces of the cleaning or treatment portion within it.

FIG. 1 schematically outlines the general architecture of an oral care system according to embodiments of the invention. The system comprises an oral care device 12, the device either comprising or being operably coupleable to a cleaning or treatment portion 14 for being received in an oral cavity of a user for performing a cleaning or treatment function. The cleaning and/or treatment portion (abbreviated herein CTP) may be a brush head of a toothbrush for example, or the head of an oral irrigator. In some cases, the whole oral care device is received in the mouth (e.g. in the case of a cleaning mouthpiece unit). Here the whole device forms the CTP (i.e. the portion can form the whole of the device). In FIG. 1, the CTP 14 is shown physically separated from the oral care device 12, e.g. a removable brush head decoupled from a powered toothbrush. This is for schematic illustration only, as will become clear in the forthcoming examples.

The oral care device 12 comprises an integrated signal generator 22 operable to generate radiofrequency (RF) and/or microwave frequency electromagnetic (EM) emissions 32 (e.g. an alternating EM field, and/or EM radiation) when said generator is operatively coupled to an emitter arrangement 24. The generator is an oscillatory signal generator, e.g. an oscillator. It may generate an alternating drive signal which is coupled to an emitter arrangement, causing emission of EM radiation, or generation of an EM field. The oral care device may comprise a local power store, e.g. a battery, for powering the generator 22.

The emitter arrangement may for example comprise a pair of electrodes driven with cyclically opposing polarities by the generator, to cause generation of an alternating field between the electrodes. Alternatively, each electrode may be driven with a separate alternating current or voltage to cause emission of EM radiation. Another possibility is use of one or more inductive coils or wire loops, driven with an alternating current to induce generation of an alternating field along an axial direction of the loop or coil. Generation of an alternating field may also lead to generation of propagating EM radiation (waves). A further possibility is the use of metamaterial-based antennas which, respond to application of an alternating electrical voltage by generating electromagnetic emissions, but making use of metamaterial structural design enable miniaturization, broader bandwidth and improved efficiency. Herein, reference will be made to generation of EM radiation. However, it should be understood that an alternating EM field may additionally or alternatively be generated in some embodiments.

The signal generator is selectively operable in a sanitization mode in which the generator is adapted to generate signals for causing a connected emitter arrangement 24 to generate RF or microwave frequency EM radiation 32 in a sanitization zone or region or area 34 around the emitter arrangement. The generated EM radiation is suitable for causing heating of at least water, or water-containing substances, for example water present on, or in contact with, any exposed surfaces of the cleaning or treatment portion 14 located in the sanitization area.

Optionally, the system may comprise a controller operatively coupled in use with the signal generator 22 for selectively switching the generator to the sanitization mode, or activating the sanitization mode. The controller may implement the sanitization mode by controlling operation of the signal generator when a sanitization mode is selectively activated. In some examples, activation of a sanitization mode may be user-actuated, e.g. with a physical button on the device, or external thereto, or with operatively coupled software (e.g. a smartphone app). The controller may be comprised by the device, or may be external thereto, but operatively connected to the signal generator. In other examples, the signal generator itself may comprise a processor or IC chip permitting local activation and implementation of a sanitization mode.

The sanitization area means a volumetric area (space or volume) around the emitter arrangement which becomes exposed to the generated EM radiation. It can be bounded or may have no definite boundary. In this area, any water present will be subject to heating through absorption of the EM energy. The sanitization area may therefore be understood as an area in which heating of water will occur from the action of the EM radiation. The sanitization area is schematically illustrated with a dashed loop in FIG. 1. This may not be representative of the actual physical shape or extent of a generated field or the emitted radiation, or the area in which water heating or steam production would occur.

Figure 2:
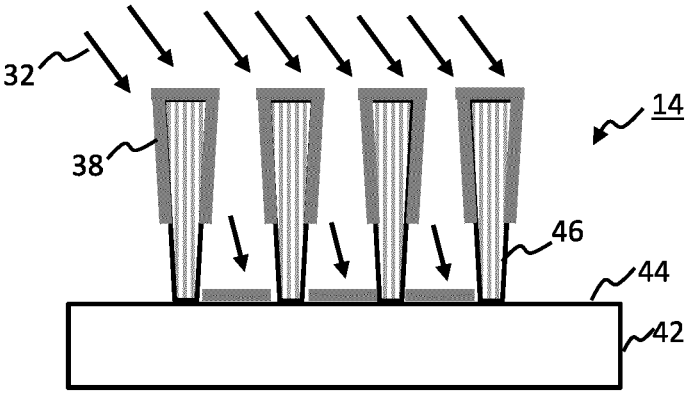
FIG. 2 schematically shows heating of fluid (in contact with surfaces of a cleaning or treatment portion) using EM energy.

FIG. 2 schematically illustrates an example cleaning and/or treatment portion (CTP) 14 in the form of a toothbrush head. Shown is a side view of a platen of the brush head, forming a support body 42, from an upper surface 44 of which upstand a plurality of cleaning elements, such as bristle bundles 46. Residual water-containing fluid 38 (e.g. water, saliva, toothpaste slurry) is schematically illustrated on exposed surfaces of the bristles 46 and upper surface 44 of the CTP 14 support body 42. During a sanitization mode, the CTP 14 is placed in the sanitization area 34 exposed to the EM radiation 32 generated by the generator 22, so that the fluid 38 is exposed to the EM radiation. This causes heating of the water content, which enables sanitization as the water rises in temperature and thereby kills microorganisms present on the bristle 46 surfaces and the CTP support body 42 surface 44 due to thermal contact from the water to the surfaces.

For heating of water for sanitization, it is preferred to generate EM radiation with frequency in the range 300 MHz to 30 GHz. It is known that efficient heating of water (e.g. to temperatures of 70° C. or above) requires application of EM energy of a certain range of frequencies for causing oscillation of the dipoles of water molecules. For example, below approximately 300 MHz, an alternating EM field or radiation will induce only frictional heating in water (ionic agitation), resulting in heat. By contrast at higher frequencies above 300 MHz, the EM energy is more efficiently absorbed by water molecules, leading to oscillatory changes of dipole orientations and molecular vibrations (kinetic energy). This heats up water faster.

Thus, in the sanitization mode, the generator 22 may drive the emitter arrangement 24 to generate EM radiation at a frequency of at least 300 MHz, for example between 300 MHz-30 GHz, for instance at least 2.4 GHz, for instance at least 2.45 GHz according to at least one set of embodiments.

Furthermore, ideally, the sanitization cycle or operation may take the water through a certain heating cycle or protocol, comprising heating the water to a defined minimum temperature and then maintaining the temperature for a pre-defined minimum time. For example, in a preferred case, the water is heated to at least 70-75° C. for at least 10-15 seconds. This has been shown to be sufficient for sanitization, in particular to kill 99.9% of bacteria and other microorganisms (sanitization=log 3 reduction=99.9% microorganisms). By way of reference, pasteurization of milk involves heating at 70-75° C. for 15 s.

This heating to a particular threshold temperature can be achieved in different ways. For example, the particular electrical characteristics (e.g. frequency, amplitude, power) of the EM signals generated by the generator 22 may be specially pre-configured so as to achieve the desired heating in use, based on an assumption regarding the size and surface area of the CTP intended to be cleaned (and therefore the volume of water to be heated) and the relative spatial arrangement of the emitter arrangement relative to surfaces of the CTP. Another option is to include sensing means for a sensing temperature in the sanitization area 34 or at surfaces of the CTP, and controlling the generator 22 based on an output of the temperature sensing so as to raise the temperature to a threshold level, and then maintain (at least) said temperature for a defined or minimum time period.

In one advantageous set of embodiments, in the sanitization mode, the generator 22 is adapted or controlled to generate signals for causing the emitter arrangement 24 to generate electromagnetic radiation 32 with, for instance, an average power output of at least 10-20 W for a period of at least 10-20 seconds. This can be achieved by generating drive signals with the generator 22, the signals having an average power of 10 W, and the signals generated for at least 10-20 seconds.

This configuration may be understood from the following exemplary calculations.

Using the specific heat of water, one may calculate the amount of energy, E, needed to heat approximately 1 ml (mass m=1 g) of water from room temperature of 20° C., to a temperature of 70° C. ($\Delta T$=50° C.) and keep it at this temperature for 15 seconds. The specific heat capacity, C, of water is 4,200 Joules per kilogram per degree Celsius (J/kg° C.). This means, it takes 4,200 J to raise the temperature of 1 kg water by 1° C. Therefore, the energy, E, required to heat approximately 1 ml (0.001 kg) of water by 50° C. can be calculated as follows:

$$F=m\cdot C\cdot\Delta T=1.0\times10^{-3}\text{ kg}\times4200\text{ J/kg}^\circ\text{ C.}\times(50^\circ\text{ C.}=0.210\text{ kJ}=210\text{ Joules}$$

Thus, the electrical energy required to perform this increase in temperature (1 ml of cleaning fluid or water to $\Delta T$=50° C.) is approximately 210 J. This may be achieved for example by driving an EM field or generating EM radiation at a power of 10 W for 21 seconds (by generating a drive signal from the generator 22 having voltage 10 V and current 1 A for approximately 21 seconds), or at a power of 20 W for approximately 10 seconds.

This is well within the range of typical charge capacity of a battery which may be included in a powered oral care device. For example, the total energy available from a single cell AA lithium battery (3.7-4.2 V, 500 mAh) is approximately about 7200 J (capacity 500 mAh: 0.5 A×3600 s×4 V=7200 J).

In summary, EM radiation created by a generator driving the emitter arrangement at a power, P, of at least 10 W (e.g. between 10-12 W) for at least 20 seconds will typically be sufficient to heat residual water on surfaces of an CTP of an oral care device (assuming a volume of approximately (in the order of) 1 ml) from room temperature to a temperature of 70° C. Likewise, the power or time can be adjusted up of down, so that the total delivered energy over the time period of the radiation generation is approximately 200 J, e.g. 210

J as stated above. If a larger or smaller volume of water is desired to be heated in use, the total energy delivered may be adjusted accordingly.

Following this heating (temperature ramping) phase, is preferably followed a further temperature maintenance phase in which water is maintained at the preferred threshold temperature (e.g. at least 70° C.) for a minimum time period, e.g. 10-15 seconds.

By way of example, to keep the temperature at an example target temperature of 70° C. for a period of t=15 seconds (example target sanitization time), this theoretically requires an additional energy, E, consumption of E=P×t=10 W×15 s=150 J. It is noted that this assumes a case of immediate heat dissipation into space. Thus, this effectively represents a maximum or worst-case additional energy requirement.

Thus, the total (maximum) energy requirement for both the heating phase and the temperature maintenance phase in this example is 210 J+150 J=360 J.

For a lithium AA battery with 7200 J energy capacity, the energy consumption for the complete sanitization program/procedure according to the present example, with both phases, is up to approximately 1/20 of the available battery energy (360 J/7200 J).

The full sanitization process in this case takes then approximately 36 seconds. An average power of at least 10 W in this case is sufficient for powering the generator 22 to generate the necessary EM field or radiation to perform the desired sanitization.

The above calculations represent only one example. The exact required drive characteristics for the generator 22 to achieve a threshold fluid temperature, and maintain for a defined time window, may depend upon the size and surface area of the CTP which is intended to be sanitized, as well as the spatial configuration of the emitter arrangement relative to surfaces of the CTP intended to be sanitized, as well as the heat capacity of the water-containing fluid exposed to the EM field (water, saliva, toothpaste slurry).

For example, assuming a standard 1 ml fluid capacity of a brush head, up to approximately 360 J of energy is needed, meaning approximately 10 W over a 36 second total sanitization process. For example, in some cases, a fluid-retaining cap may be placed over the brush head while it is submerged, to trap a volume of water in the interior cavity of the cap, surrounding the brush head and bristles. The typical volume of this cap may be (by way of example) approximately 1 ml.

However, less power and/or energy may be needed if less water is present at the brush head, for example if only residual water on the bristles is used for sanitization. In this case, the required amount of energy needed may be significantly less. The power level may be user-configurable in some examples, depending upon whether the CTP is to be submerged, or just residual water is to be heated. Alternatively, this can be detected in some examples automatically with a sensing module.

As mentioned above, there are different options for the location of the emitter arrangement.

In one set of embodiments, the emitter arrangement 24 is comprised by an external unit, for example a sanitization station, which may define a dedicated sanitization area or cavity for receipt of the CTP 14 during sanitization. In this case, the oral care device 12 may electrically dock or couple with the sanitization station, and establish electrical coupling between the generator 22 of the oral care device and the emitter arrangement. This avoids the need for providing a separate power source or any active electrical components in the separate sanitization unit. An oral care device may typically already include a power source, for example for use in driving a mechanical actuator of the device (e.g. a powered toothbrush).

In a further set of embodiments, to be discussed in detail herein, the emitter arrangement 24 may be comprised by the cleaning and/or treatment portion (CTP) 14 of the oral care system itself. This integrated CTP and emitter arrangement may be understood as forming a sanitization cell when the system is in the sanitization mode. The CTP refers to the part of the oral care device which may be received in the mouth for performing a cleaning or treatment function, e.g. a toothbrush head or a brushing mouthpiece unit. This can be a part of the oral cleaning or treatment device 12 (either integrally comprised thereby or removably coupleable thereto), or may be a separate part and operatively coupleable to the device 12 in operation. In other words, the oral care device can, according to one aspect of the invention, be provided by itself, so long as it comprises the generator 22 and is at least coupleable with a CTP 14.

Figure 3:
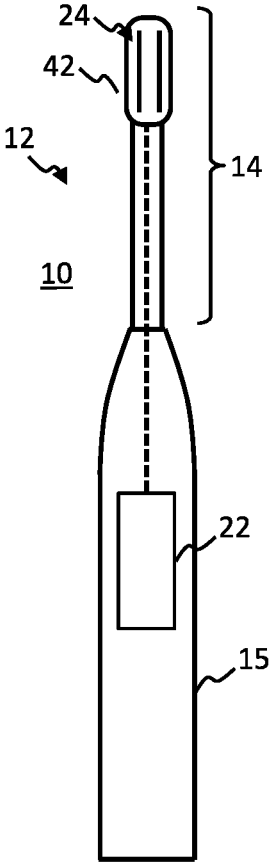
FIG. 3 schematically shows an example oral care device.

FIG. 3 schematically illustrates one example oral care system 10 comprising an oral care device 12 in the form of a powered toothbrush which is coupleable to a detachable CTP 14 in the form of a brush head attachment. A platen 42 of the brush head comprises the emitter arrangement 24. An electrical coupling is provided between a signal generator 22 integrated in a body portion 15 of the oral care device 12 and the emitter arrangement 24 integrated in the CTP 14. The electrical connection is established when the brush head 14 is connected or mated to the body portion 15. A toothbrush is only one example of a suitable oral care device. Other examples include a brushing mouthpiece unit, and oral irrigator, or a powered flossing device. The system 10 of the invention may include just the body portion 15 of the oral care device 12 or may include both the body portion 14 and the cleaning and/or treatment portion 14.

Figure 4:
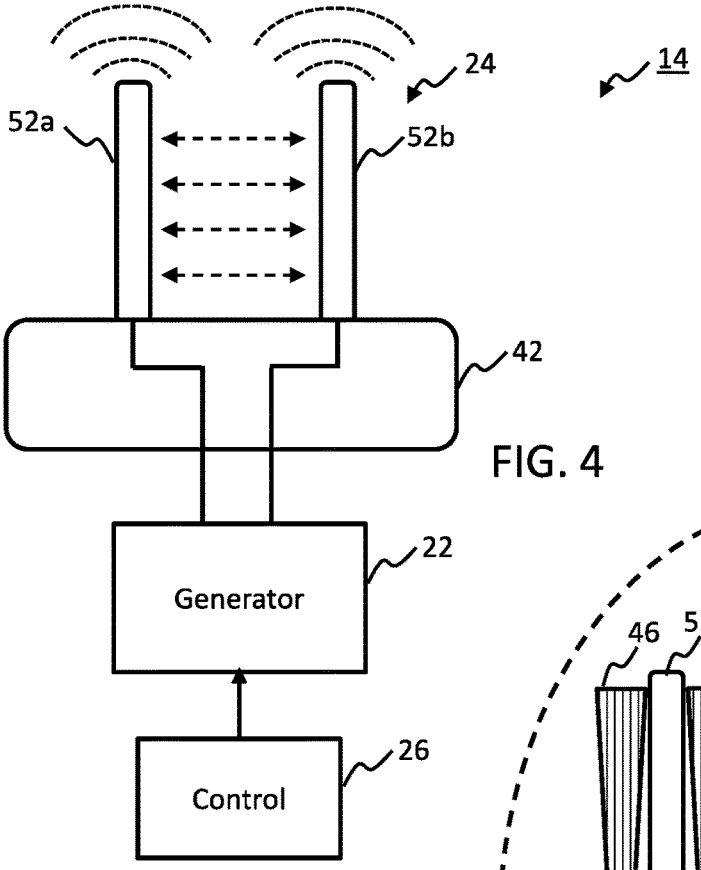
FIGS. 4-5 show an example oral cleaning or treatment portion of an oral cleaning or treatment device comprising an emitter arrangement of a generator circuit.

FIG. 4 schematically illustrates in more detail an example CTP 14 having the emitter arrangement 24 carried thereby. In this example, the CTP comprises a support body 42, for example a platen of a brush head (bristles not shown in FIG. 4), from an upper surface 44 of which extends a pair of electrodes 52*a*, 52*b* which form the emitter arrangement 24. The electrodes are connected to the signal generator 22 which drives an alternating voltage or current between them. For instance, they are driven with cyclically opposing polarities to thereby generate an alternating EM field or EM radiation between the electrodes and in a space around the electrodes (the sanitization area). Optionally a controller 26 may be provided operatively coupled to the generator 22 to control operation of the generator. The controller may control selective implementation of the sanitization mode for example. Both, the signal generator and controller may be implemented in a body portion of the oral care device (not shown in FIG. 3).

Figure 5:
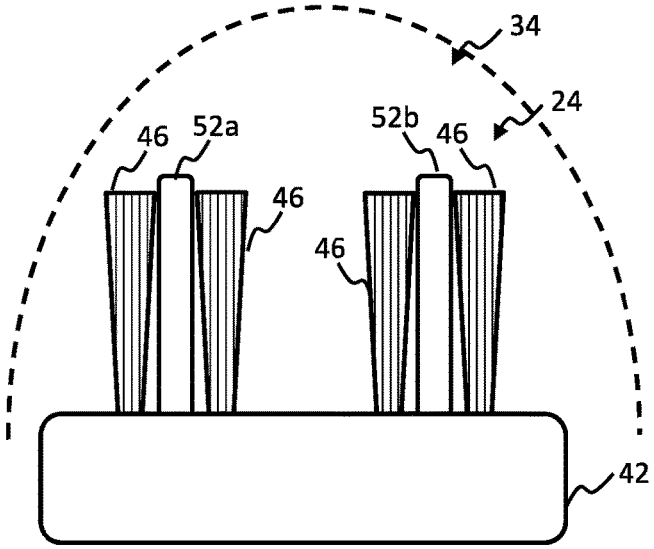

As illustrated in FIG. 5, the electrodes 52*a*, 52*b* may be surrounded on one or both sides by cleaning elements such as bundles of bristles 46. The electrodes may be nestled amongst a group of bristles for example. The sanitization area 34 formed by the emitter arrangement 24 is schematically illustrated. In this case, the sanitization area is a region between and around the emitter arrangement (the pair of electrodes) encompassing at least a portion of the cleaning and/or treatment portion 14, for example at least the support body 42 which carries the cleaning elements 46 (e.g. bristles) which are received in the mouth during use. Thus, the bristles and upper surface of the support body 42 to which they are attached are exposed to the electromagnetic energy for sanitization during the sanitization mode.

Figure 6:
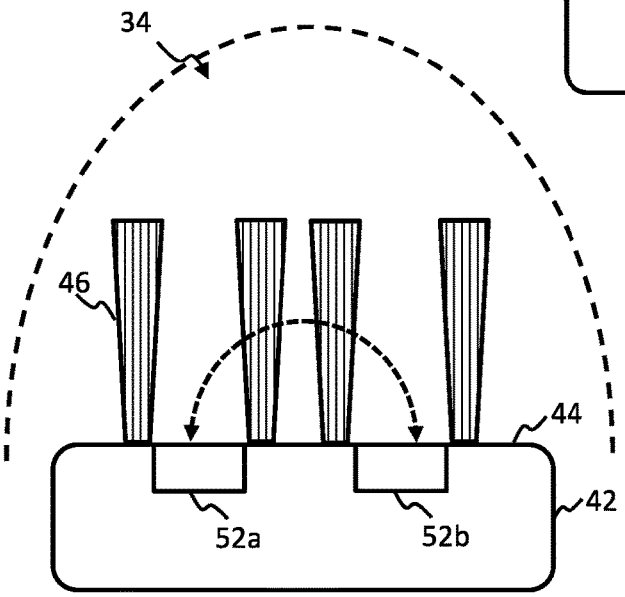
FIG. 6 shows a variation of the arrangement of FIG. 5, wherein the emitter arrangement is embedded in a surface of the cleaning or treatment portion.

In an alternative example (FIG. 6), the emitter arrangement 24 may include electrodes 52*a*, 52*b* which are integrated beneath the surface 14 of the support body 42 (e.g. platen) of the CTP 14. They may be flush with the upper surface 44 of the support body 42 and with conductive surfaces exposed, or may be buried beneath the surface. The operation of the pair of electrodes 52*a*, 52*b* may be otherwise the same as previously discussed.

Figure 7:
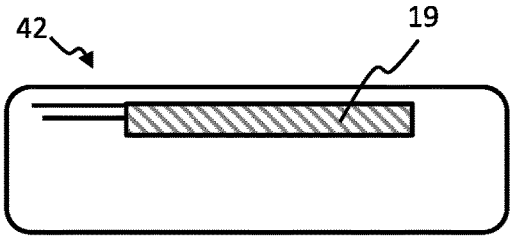
FIGS. 7-8 shows a further variation of the arrangement of FIG. 5, wherein the emitter arrangement is embedded in a surface of the cleaning or treatment portion and comprises one or more loop coils.
Figure 8:
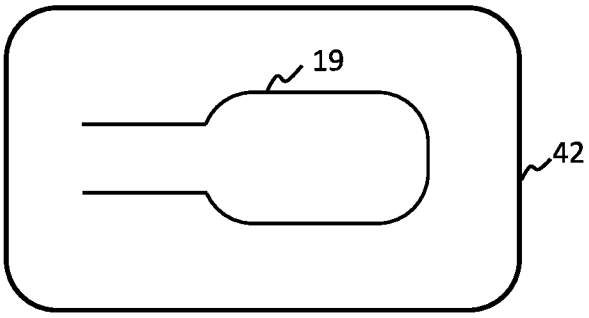

FIGS. 7 and 8 show a further variation. Here, instead of electrodes, the emitter arrangement 42 may comprise one or more inductive loops or coils 19 which are driven by the generator 22 with an alternating current or voltage to generate an alternating electromagnetic field along an axial direction relative to the loop. The alternating field also results in radiation of EM waves into the surrounding space.

According to an advantageous set of embodiments, the signal generator 22 may be further selectively operable in a cleaning or treatment mode in which the generator is adapted or controlled to generate signals for causing a connected emitter arrangement 24 to generate electromagnetic radiation for performing an oral cleaning or treatment function in the oral cavity.

In the cleaning or treatment mode, the generator 22 may cause generation of EM field or radiation having a lower electromagnetic frequency than in the sanitization mode. For example, electromagnetic fields or radiation at radio frequencies are known to be effective for use in cleaning or treatment of tooth surfaces or gum tissue. For example, they can weaken biofilm on tooth surfaces which can actively assist during cleaning of teeth with the cleaning or treatment portion 14. Radio frequencies can also stimulate gum tissue which can have local heating effects. A suitable range of frequencies for the cleaning or treatment mode may be for example between 1 MHz and 300 MHz, for example between 1 MHz and 30 MHz.

By contrast, for the sanitization mode, a suitable range of frequencies may be between 300 MHz and 300 GHz, for example between 2 GHz and 30 GHz.

A controller 26 may be provided operatively coupled with the generator 22 and adapted to control selective activation of the sanitization mode and the cleaning or treatment mode. Selective activation of the different modes may be performed responsive to a user control signal from a user input element, such as one or more buttons provided on an external surface of the oral care device, or an external computing device such as a smartphone or tablet computer.

Thus, the same signal generator 22 and emitter arrangement 24 is used both for the electromagnetic cleaning function and for the electromagnetic sanitization function. In embodiments in which the emitter arrangement is comprised by the CTP, an integral RF cleaning arrangement is in this case thus reconfigured to become an integral sanitization cell.

In some examples the sanitization mode may be automatically triggered upon completion of an oral cleaning cycle. An oral cleaning cycle may mean for example use of the device in its normal oral cleaning or treatment function, e.g. use of a powered toothbrush to brush teeth or use of a powered mouthpiece device to clean teeth. Thus, the cleaning or treatment portion is automatically sanitized after each use of the oral care device.

In accordance with one or more embodiments, the oral care device 12 may further include a mechanical actuator for providing a source of mechanical movement, the mechanical movement being mechanically coupled to the cleaning or treatment portion 14 during use, or adapted to be mechanically coupled to the cleaning or treatment portion when said portion is operatively connected. The mechanical actuator may be controlled to be active during the sanitization mode to provide combined mechanical agitation and EM sanitization during the sanitization mode. This may enhance sanitization efficacy. The actuator may for example be a drive train mechanism of a powered toothbrush arranged to transfer oscillatory motion to the brush head in use. This is just one example however and many types of oral care device include movement actuators.

In accordance with one advantageous set of embodiments, the oral care system 10 further comprises an electromagnetic (EM) shield unit 62 for assisting in containing the generated electromagnetic energy within the sanitization area 34. It may thus enhance efficiency of the sanitization process by preventing leakage of the EM radiation 32 from the sanitization space.

The EM shield unit 62 may be configurable in a deployed position for use during the sanitization mode, in which the shield unit is arranged in a defined spatial relationship with respect to the sanitization area 34 and is adapted to at least partially inhibit leakage of electromagnetic energy from the sanitization area. It may further be configurable in a non-deployed position in some examples, e.g. to permit normal use of the CTP 14.

In embodiments where the emitter arrangement 24 is not comprised by the oral care device 12 or by the cleaning or treatment portion (CTP) 14, the shield may be part of a housing of a sanitization station, e.g. at least partially surrounding a sanitization chamber within which the cleaning or treatment portion is receivable.

In other embodiments, it may be a component configured to be connected or mounted to the oral care device 12 or the CTP portion 14 in the deployed configuration with a fixed spatial relationship with respect to the sanitization area 34.

In general terms, the shield unit 62 should be formed with a construction or material suitable for impeding passage of electromagnetic energy through it. The shield unit may comprise one or more shielding surfaces arranged in the deployed configuration to face the sanitization area to interrupt escape of electromagnetic field energy from the sanitization area. It therefore acts to at least partially contain the electromagnetic radiation within the sanitization area. The shield unit may be arranged to at least partially bound or delimit the sanitization area. The sanitization area may be defined as an area which is at least partially bound by the shield unit. The shield unit may comprise a single piece or multiple pieces. The shield unit may concentrate the electromagnetic radiation within the sanitization area.

In preferred examples, the shield unit 62 may be configured for at least partially reflecting incident electromagnetic radiation toward the sanitization area 34. The shield unit may comprise one or more electromagnetic-reflective surfaces adapted to at least partially reflect the electromagnetic energy generated by the emitter arrangement 24 in the sanitization mode, for use in at least partially containing said radiation in the sanitization area when the shield unit is placed in the deployed configuration.

In the deployed configuration, the shield unit may comprise at least one surface portion arranged facing the sanitization area, and arranged to deflect the EM radiation back toward the sanitization area if intercepted thereby.

Thus, in the deployed configuration, the reflective surface portions or elements may be arranged to deflect radiation toward the sanitization area from one or more sides around the sanitization area.

This may also provide an amplifying effect. For example, if the shield unit is shaped to at least partially bound or surround the sanitization area, the shield unit may form a partial resonator cavity containing the sanitization area and the CTP.

In some examples, the shield unit may form a partial cavity formed of one or multiple metamaterial units.

The shield unit may comprise a plurality of shielding walls arranged around an interior space or cavity which defines the sanitization area.

In an embodiment in which the CTP is a toothbrush head, the deployed configuration may have the shield unit reflecting EM waves toward the bristles or platen surface of the cleaning or treatment portion (CTP).

There will now be outlined a number of possible embodiments for the shield unit.

According to a first set of embodiments, the shield unit 62 is physically separable from the oral care device 12 in a non-deployed configuration, and is adapted to be mechanically mountable or connectable to the oral care device in a deployed configuration.

Different examples in accordance with this first set of embodiments will now be outlined.

In accordance with one set of examples, the shield unit 62 may take the form of a cap or cover defining an internal cavity or space, and arranged in the deployed configuration to fit over at least a portion of the cleaning or treatment portion 14 with said portion at least partially received in the cavity.

The cap has bounding walls formed of a material configured at least partially retain EM radiation within the cavity. It preferably reflects or redirects the EM energy toward surfaces of the CTP.

This type of shield unit is suitable for embodiments in which the emitter arrangement 24 is comprised as part of the CTP 14.

The emitter arrangement comprised by the CTP 14 is arranged to be received in the cavity when the shield unit is in the deployed configuration.

In preferred examples, the cap or cover comprises electromagnetically reflective surfaces or coverings on interior surfaces of the cap facing inward toward the cavity defined by the cap or cover. These thus act to reflect or deflect the electromagnetic radiation toward the sanitization area around the emitter arrangement 24 comprised by the CTP 14.

The reflective surfaces may be formed of a metal such as (polished or perforated) aluminum, silver or copper. The reflective surfaces may comprise coatings or mesh claddings of the relevant material.

The reflective surfaces may be alternatively be formed of non-metal materials such as silicon, or dielectric materials with metal insertions.

One example is shown in FIGS. 9-12.

Figure 9:
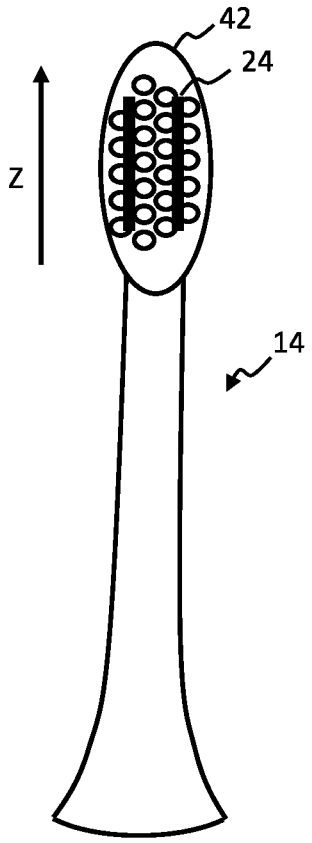
FIG. 9 illustrates an example oral cleaning and/or treatment portion.

FIG. 9 shows the cleaning or treatment portion (CTP) 14 to which the cap may be configured to be fitted. The CTP in this example takes the form of a brush head for a toothbrush. The brush head comprises a platen 42 forming a support body from which a plurality of bristle bundles extend. The position of an example emitter arrangement 24 is schematically shown.

Figure 10:
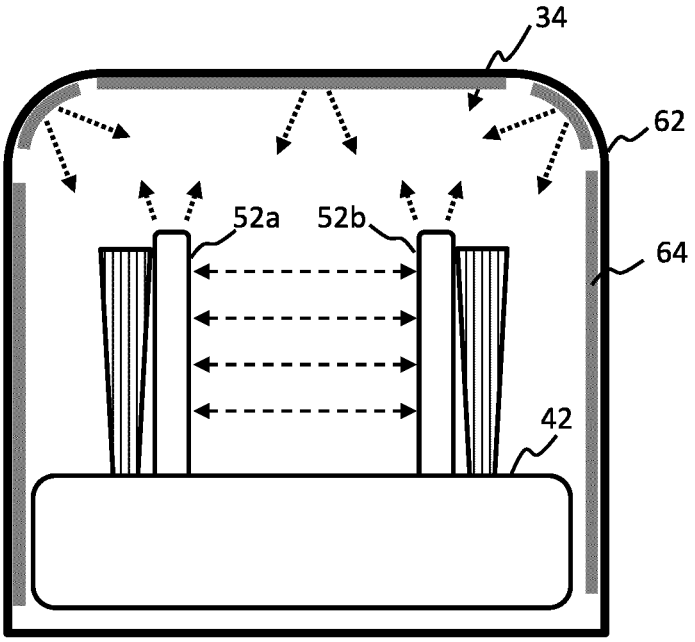
FIGS. 10-12 illustrate an example EM shield unit in the form of a cap or cover for mounting over a portion of an oral cleaning and/or treatment portion.

FIG. 10 shows the cap shield unit 62 in its deployed position, fitted over the support body 42 of the CTP 14. A cross-section is shown, facing in the z direction indicated in FIG. 9. As shown, the cap surrounds the emitter arrangement (electrodes 52*a*, 52*b*) and the support body 62 on at least an upper, side and rear surfaces. In some cases, the bottom of the shield may be open since this is already substantially blocked by the support body 42. A front surface may in some cases also be open.

As illustrated, the shield unit cap 62 includes EM reflective surface portions 64 on interior surfaces which reflect incident portions of the EM field or radiation back toward the sanitization area 34 (toward the emitter arrangement and the CTP 14 and the bristle field). The conductive surfaces 64 may be a metal coating, or metal mesh structure (such as in a Faraday cage). In some cases, a microwave metamaterial element may be provided.

Metamaterials are an emerging technology and relate to engineered materials characterized by their structure (geometric arrangement of one or more materials) rather than by their material composition. Metamaterials enable achievement of new physical properties and features that are either not available, or difficult to utilize, in naturally occurring materials, such as a negative refractive index for example.

Microwave metamaterials are composed by a multiplicity of units whose effective properties (refraction index, permittivity, permeability) are exotic (not common in natural materials) allowing EM wave manipulation (for instance, promoting super-reflection or focusing) for a desired frequency band. A more detailed discussed on microwave metamaterials may be found for example in the paper: Tie Jun Cui, Microwave metamaterials, National Science Review, Vol 5, Issue 2, March 2018, Pages 134-136.

The main body of the cap shield unit 62 may be formed of a different material, e.g. plastic. In some cases, a plastic protection cap is supplied with, for instance, toothbrushes to protect the bristle field. This same cap may be modified to form the shield unit 62.

Figure 11:
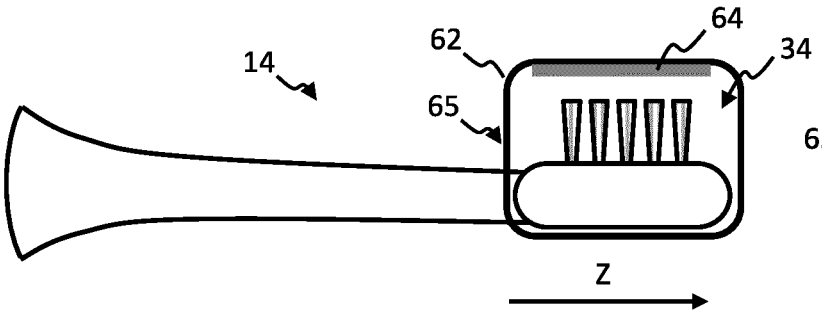

FIG. 11 shows a side elevation view of the shield unit 62 in the deployed configuration, fitted (e.g. slid) over the CTP and the emitter arrangement. A front end 65 of the shield unit 62 may be open to permit receipt of the top of the CTP 14 into the cap.

In a deployed configuration, the cap 62 is fitted over the part of the CTP 14 which includes the emitter arrangement. In a non-deployed configuration, the cap is slid off from the CTP 14, so that the CTP can be used in associated with the oral cleaning or treatment device 12 for oral cleaning or treatment function.

Figure 12:
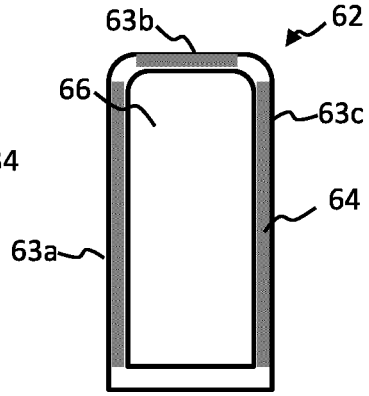

FIG. 12 shows the shield cap 62 in the non-deployed configuration. The shield unit 62 is thus physically separable from the CTP 14 in the non-deployed configuration, and mechanically mounts to the CTP in the deployed configuration. The shield unit 62 has shielding walls 63 which surround an inner cavity 66. The reflective surface portions 64 may be formed on an interior surface of the walls, or the walls may themselves have inner surfaces which form reflective surface portions.

Figure 13:
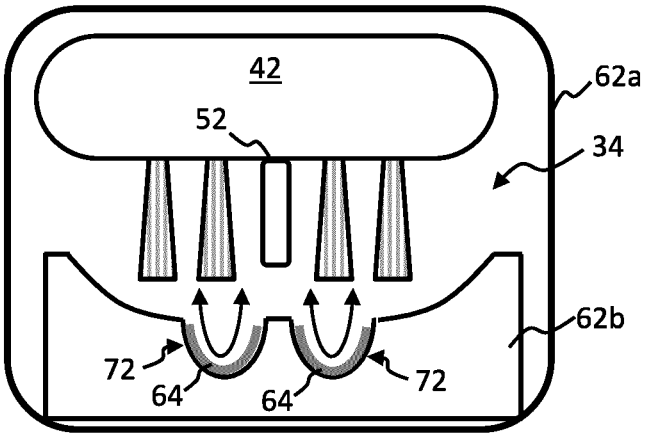
FIGS. 13-15 illustrate a variation on the cap or cover of FIGS. 9-12, comprising a shaped reflector portion at a base comprising concave reflector areas.

FIG. 13 shows an example shield unit 62 in the form of a cap, and comprising a shaped lower portion facing toward the sanitization area 34, and in this example toward the support body 42 and the bristle field having indentations/pits 72 with reflective surfaces 64 for providing directional deflection of the electromagnetic field or EM waves radiated by the emitter arrangement 52. This may form a portion 62*a* of the shield unit 62, with for example the remaining shell of the shield unit, which surrounds the sanitization area 34, forming a second portion 62*b*.

The shaped lower portion 62*b* may for example be formed with concave surfaces 72. The concave surfaces may be provided with coated metallic disc resonators 64, and this 62b portion provided on the side of the cap facing the bristles. This can promote optimal reflection characteristics.

For example, the curvature shape of the reflectors 64 can be configured to achieve a direct reflection directivity within the cap to maximize sanitization efficiency. The reflective surfaces can be made to be frequency selective in some examples.

The shaped lower portion could be formed by 3D printing for example.

Figure 14:
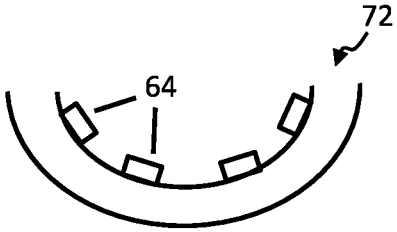
Figure 15:
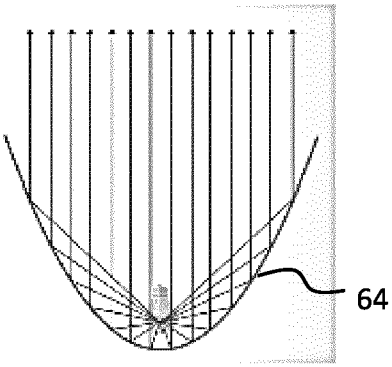

Continuous reflective surfaces 64 can be formed in the indentations 72, or, as shown in FIG. 14, reflective elements 64 provided at spaced intervals around the inner surface to provide the required directional reflectivity. The result can be as shown in FIG. 15, wherein a form of parabolic or otherwise concave reflector forms a plane EM reflection front. The continuous reflective surfaces 64 or reflective elements may be formed of any suitable EM reflective material, including for example an EM metamaterial.

In cases in which the EM sanitization process is combined with mechanical agitation cleaning provided by the mechanical actuator (e.g. toothbrush drive train mechanism), the cap may cause noise due to contact between the cap rims and the CTP 14. The cap may optionally be formed of a conductive rubber to mitigate noise. Alternatively, it may be formed of a combined acoustic and microwave metamaterial which may attenuate sound radiation and avoid noise issues.

Microwave metamaterials have been discussed above. Acoustic metamaterials can be formed which show negative or near-zero dynamic density and/or elastic modulus. Acoustic metamaterials may be constituted of sub-wavelength unit cells, for example in a periodic arrangement. Acoustic metamaterials are characterized by exhibiting mechanical (acoustic) frequency bands in which wave propagation through the material cannot occur. These non-propagating frequency bands are known as band gaps of the material. Different units of the material can have different band gaps. These enable non-conventional ways of manipulating energy. A combined metamaterial can be formed having a structure designed to achieve both EM wave manipulation (reflectivity) and suppression of certain resonant acoustic vibrations (to reduce noise).

In accordance with one or more embodiments, an upper surface of the platen 42 (or other support structure), facing the sanitization area, may be provided with one or more reflective surface portions for reflecting or re-directing electromagnetic energy toward the sanitization area.

Figure 16:
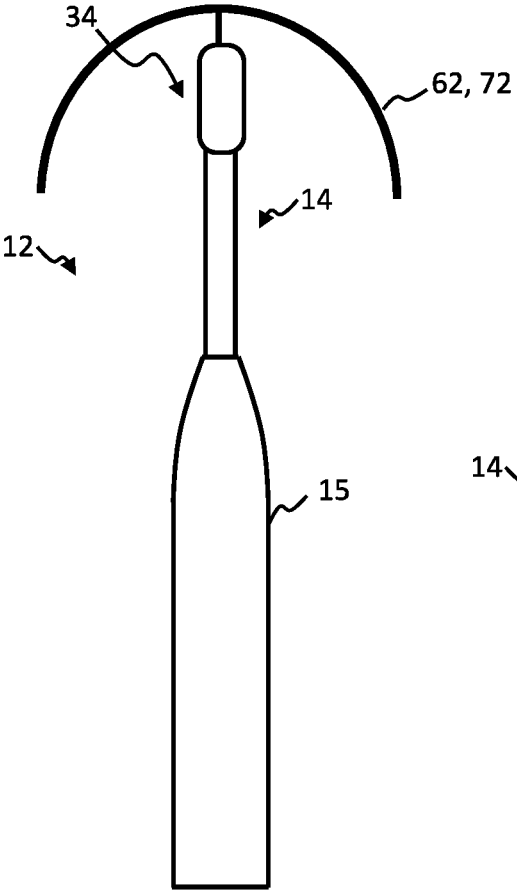
FIG. 16-18 illustrate a further example EM shield unit in the form of an umbrella unit.
Figure 17:
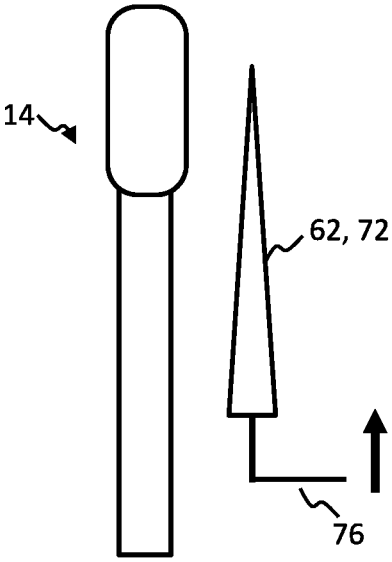
Figure 18:
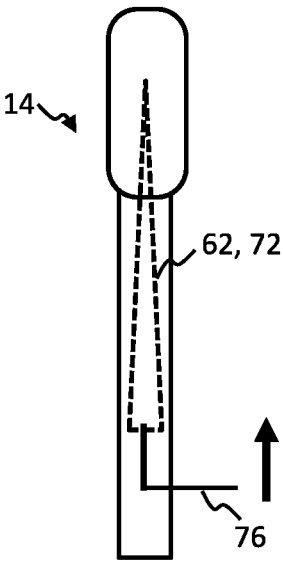

FIGS. 16-18 show a further example of a shield unit 62. The shield is in the form of an umbrella structure 72 which forms a cover over a top of the CTP 14 of the oral care device and extending part way down the length of the CTP 14. The umbrella structure 72 may include an EM reflective coating on its undersurface, facing the CTP 14 to provide the function of at least partially retaining the EM radiation within the sanitization area 34.

The umbrella 72 may be integrated in an inner bore channel formed through the axial core of the CTP (e.g. the neck of toothbrush head in this example) and arranged to be slidable along said bore channel to move it from a non-deployed position (retracted in the neck of the toothbrush head) and a deployed position (protruding out from the top of the toothbrush head). A user control element (e.g. lever) 76 may be provided protruding outwardly from the neck of the toothbrush head to allow for a user to manually move the shield to the deployed configuration.

Figure 19:
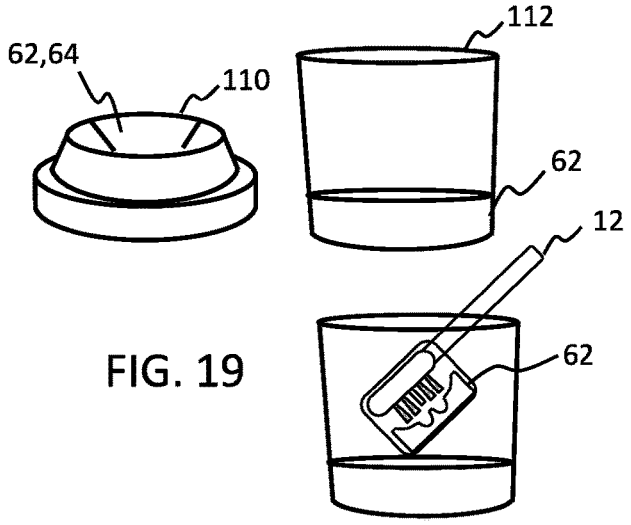
FIG. 19 illustrates a further example EM shield unit in the form of, or incorporated in, a charging cradle of an oral cleaning or treatment device.

FIG. 19 illustrates a further example of an electromagnetic shield unit 62 in which the shield unit is a component of, or is integrally incorporated into the body of, a charging station for the oral care device 12. In the example shown, the charging station comprises a cup 112 which is placeable atop a base portion 110, the base portion including inductive electronics for inductively charging the oral care device, e.g. toothbrush. The shield unit 62 may comprise shielding walls, e.g. reflective walls, incorporated into the base portion 110 to reflect the electromagnetic field or radiation from the base of the charging station. The shield unit 62 may be further incorporated around a base rim of the cup 112. This may be used in some examples in combination with the shield 62 discussed above.

Figure 20:
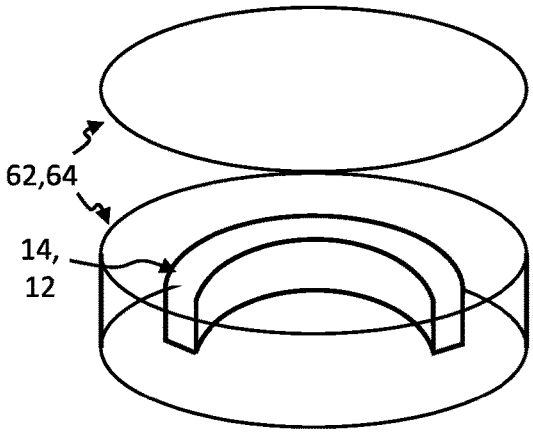
FIG. 20 schematically illustrates a further example EM shield unit incorporated in a storage or travel case of an oral cleaning or treatment device.

Another example is shown schematically in FIG. 20 in the form of a storage or travel case in which the oral care device 12 is receivable. The example depicts an oral care device 12 in the form of a mouthpiece unit which is receivable in the mouth for performing an oral cleaning function. The case for holding the mouthpiece unit may have electromagnetically reflective inner surfaces for at least partially preventing escape of the electromagnetic field or radiation generated by emitter arrangement 24 comprised by the mouthpiece unit.

A shielding unit 62 may also be incorporated into walls and/or lid of a travel case designed to receive an electric toothbrush in some examples and designed to at least partially deflect the electromagnetic field or radiation towards the toothbrush. In this way sanitization can be performed with the toothbrush received in the travel case, allowing for portable sanitization capability. It also may allow for drying of the toothbrush through the evaporation of the residual water on surfaces of the cleaning or treatment portion 14. The sanitization mode may be active during travel. When the user arrives at the destination, the toothbrush head is dry as well as sanitized.

In accordance with a second set of embodiments, the shield unit 62 may be adapted to be mechanically transitionable (manually or electronically) between a non-deployed position and a deployed position and wherein the shield unit is mechanically connected or mounted to the oral care device in both positions. The deployed position may have the shield unit at least partially covering or facing the sanitization area (e.g. the cleaning or treatment portion), and the non-deployed configuration may have the shield unit in a different position (e.g. retracted, and not facing the sanitization area).

Thus, in these embodiments, the oral care device and/or cleaning or treatment portion 14 may have the shield unit 62 integrated therein.

Figure 21:
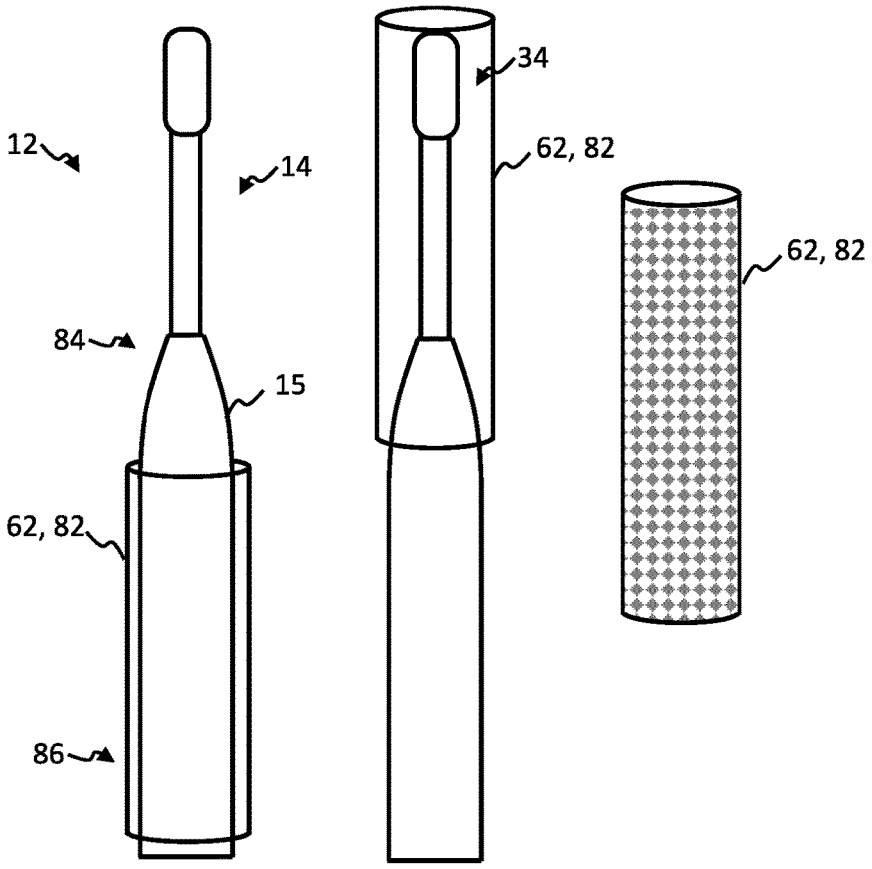
FIG. 21 illustrates a further example EM shield unit comprising a sleeve article slidable along a body of an oral care device for placement in a deployed position.

One example is shown in FIG. 21, in the form of a retractable sleeve article 82 designed to slide along the body of the oral care device.

In general, in this arrangement the oral care device 12 has a body portion 15 having an operative end 84 and a handle end 86. The oral cleaning or treatment portion 14 is connectable to the operative end 84 of the body portion 15, and wherein the shield unit 62, 82 is adapted to be slidable along the body portion of the oral care device 12 between the operative end and the handle end.

In the example shown, the shield unit is in the form of a sleeve which wraps coaxially around the body 15 of a powered toothbrush. FIG. 21, left, shows the sleeve in the non-deployed configuration, FIG. 21, right shows the sleeve in the deployed configuration in which it is arranged encircling the cleaning or treatment portion 14 (the brush head in this case). There may be reflective surface portions or elements provided on the interior faces of the sleeve to assist in reflecting the electromagnetic field or radiation toward the sanitization area 34 inside the sleeve.

The sleeve 62, 82 (like the cap in FIGS. 10-12) may provide a dual function of protection of a bristle field of the brush head and providing a sanitization enhancing function.

In a further example embodiment, the shield unit 62 may be adapted to at least partially cover the sanitization area when in a deployed configuration, and wherein the shield unit is adapted fold and unfold to move it between non-deployed and deployed configurations.

Figure 22:
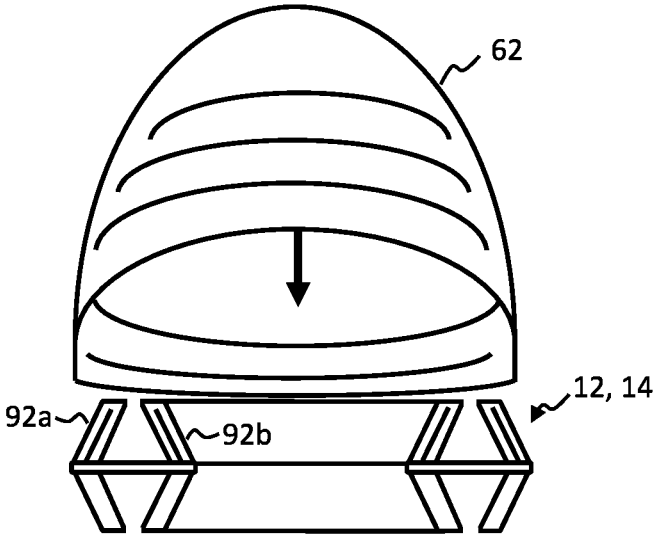
FIGS. 22-24 illustrates a further example EM shield unit which is foldable in concertina fashion for deployment and retraction.
Figure 23:
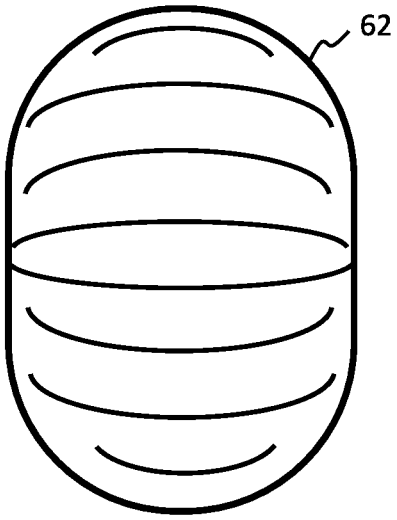
Figure 24:
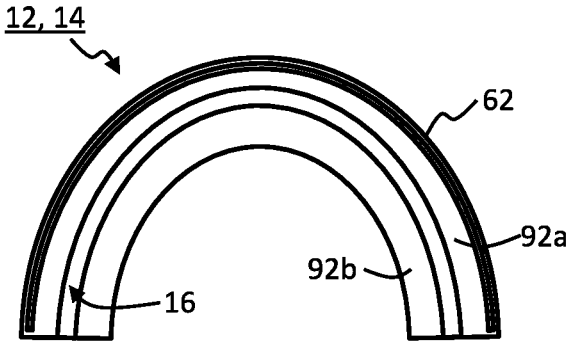

An example is schematically illustrated in FIGS. 22-24. In the illustrated example, the shield 62 is designed to be used with an oral care device 12, 14 in the form of a mouthpiece unit. The shield may unfold in concertina fashion from a retracted position in which the shield is received in a cavity in a top or bottom surface of the mouthpiece unit. The shield can be integrated in the mouthpiece or provided as a separate accessory. FIG. 22 shows unfolding of the shielding unit 62 from its retracted position. FIG. 23 shows the shield in its deployed position in which it may fully surround the mouthpiece unit. FIG. 24 illustrates retraction of the shield unit 62 within an arcuate cavity at the back of a top surface of the mouthpiece unit. The mouthpiece unit generally includes two protruding upper wall portions 92*a*, 92*b* which define a tooth-receiving channel 16 therebetween. An additional arcuate channel may be provided on an outer perimeter of the mouthpiece unit for example, within which the shield may be foldably retracted. In a retracted position, preferably the shield unit is hidden from view.

In accordance with one or more advantageous embodiments, in the sanitization mode, the generator 22 may generate an electromagnetic (EM) field or EM radiation using the emitter arrangement 24 for converting water-containing fluid within the sanitization space 34 into steam, typically at 100° C. at atmospheric pressure. Conversion of water to steam makes the sanitization far more efficient, since it enables disinfection.

For example, residual water on surfaces of the cleaning or treatment portion (CTP) 14 may be heated with the electromagnetic field or radiation to a temperature at which the water is converted to steam. For example, with reference to a toothbrush examples, it has been found that this there is typically less than 0.1 g of water on a wet brush after it has been wetted and removed from the water source. By way of example, such a volume of water, if heated by energy generated from an electromagnetic field or radiation, at a power of 10 W, would enable steam generation within a time period of just 4 seconds, if all or most of the most of the electromagnetic energy is absorbed by the residual water.

To assist with efficient absorption of the EM energy, to generate steam, this embodiment may employ use of a cover to contain or retain the heat. This may be a thermally stable (and ideally insulative) cover and optionally may also perform an EM shielding function, as described in relation to any of the examples discussed above. It may have structural strength sufficient to withstand pressure generated by steam within the cover.

By way of example, a cover unit may be provided having a deployed configuration in which is it arranged to enclose the sanitization area to at least partially restrict escape of heat, for encouraging steam generation in the sanitization area, and having a pressure relief opening (or valve) to permit controlled escape of steam if for example pressure continues to build.

In one set of examples, the cover unit may take the form of a balloon or cap, which may be formed in certain examples of a temperature stable rubber. In the sanitization mode, a moist or pre-wetted brush head may be received within the balloon. The balloon has a pressure relief hole or vent. The cover unit may be integrated in the oral care device (for example moveable between deployed and retracted configurations) or supplied as a separate part. This part may be mountable to the CTP in some examples to put in into the deployed configuration. In examples in which the emitter arrangement is separate from the CTP 14, the cover unit may be formed by a housing of a separate sanitization unit for example, which may be sealable around a sanitization area designed to receive the CTP 14.

In a further example, the cover unit may take the form of a cap, for example of similar outer shape and configuration to the cap discussed above in relation to the EM shielding options, and with reference to FIGS. 9-12.

Figure 25:
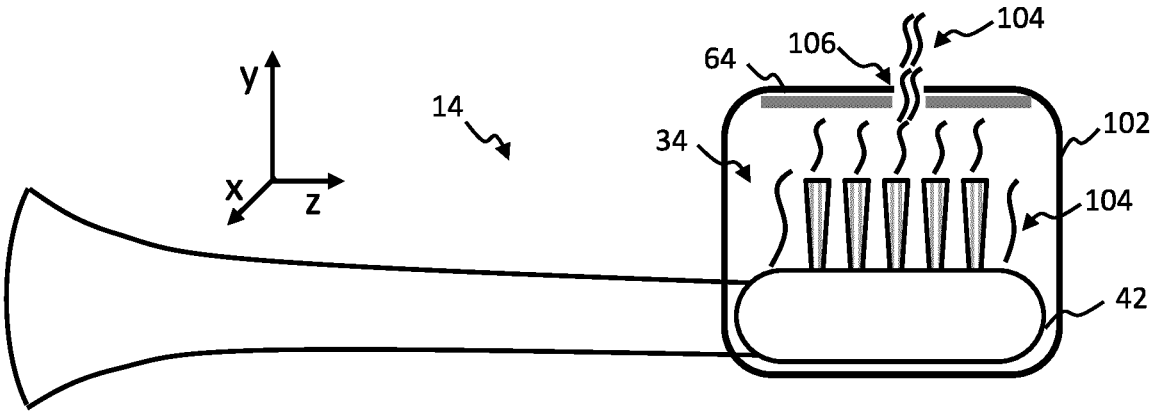
FIGS. 25-26 illustrate a cover unit for retaining heat for encouraging steam generation.
Figure 26:
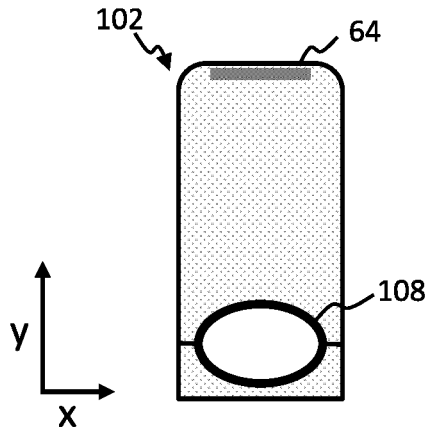

One example is shown in FIG. 25 and FIG. 26. In this example, the CTP 14 is in the form of a brush head for a toothbrush. A cover unit 102 is provided in the form of a cap which surrounds a portion 42 of the CTP 14 which carries cleaning elements in the form of bristles and also carries the emitter arrangement 24. (not visible in FIG. 25). FIG. 25 shows the cover unit 102 in its deployed position, fitted over the support body 42 of the CTP 14. The cap may surround the emitter arrangement and the support body 42 on at least an upper, side and rear surfaces. The cap is arranged to enclose the sanitization area formed around the emitter arrangement on the support body 42 to contain generated heat, and thereby encourage more efficient generation of steam.

As shown in FIG. 26, the cover unit may be arranged to seal around the CTP 14 with a sealing lip 108, to thereby seal the portion of the CTP which is received in the cover. It seals the sanitization area to ensure steam can be most efficiently generated. The cap may therefore fluidly seal the sanitization area apart from the pressure relief opening 104. This better contains the heat in the space, and allows for controlled venting of the steam.

Optionally, the cover unit may further comprise one or more electromagnetic reflective surfaces 64 or elements for at least partially reflecting the electromagnetic field or radiation toward the sanitization area 34.

The generator 22 may be selectively operable in a steam mode (e.g. a "flash steam" mode), which may be understood as a specialized example of a sanitization mode. The steam mode may be designed to be used with the cover unit 102 (especially if only a very small amount of fluid is present in the sanitization area (e.g. moist brush head after cleaning and shaking off excess water). In the steam mode, the generator may for example generate EM radiation for a shorter period than during the normal sanitization mode. For example, as discussed above, the generator may generate the radiation with a power of at least 10 W for approximately 4-10 seconds. The generator 22 may be selectively operable in either the steam mode or the normal sanitization mode in some examples. A controller may be provided to facilitate switching between modes.

In accordance with one or more embodiments, the system may include means for detecting moisture and/or temperature within the sanitization area by means of analysis of electrical characteristics of the emitter arrangement.

Figure 27:
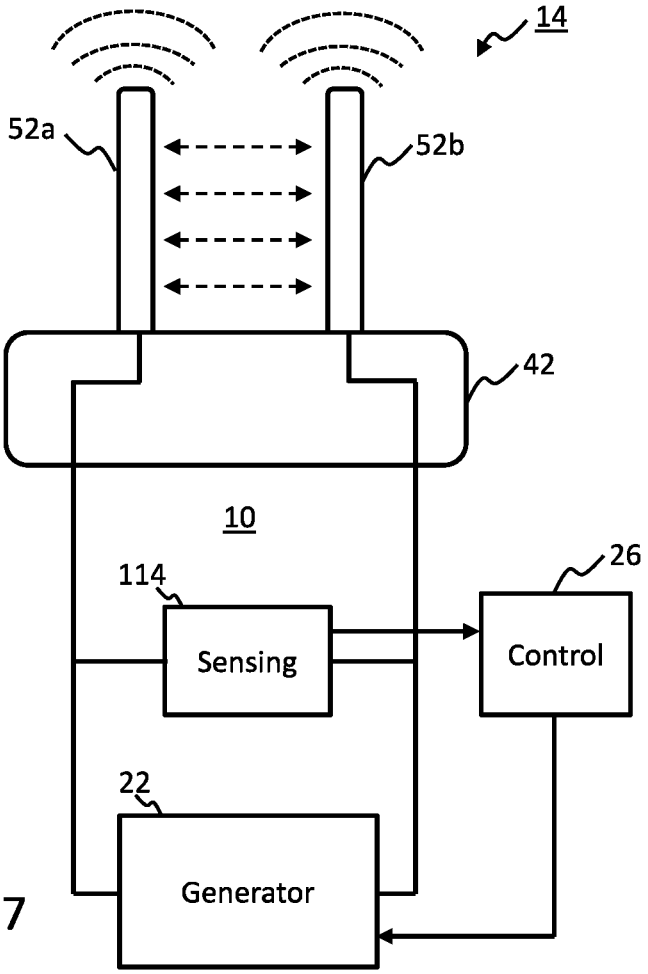
FIG. 27 illustrates an EM generation circuit with sensing capability for sensing temperature and/or moisture in the sanitization area.

For example, and as schematically illustrated in FIG. 27, the generator 22 and emitter arrangement 24 may be understood to form a generation circuit. The oral care device 12 may further comprise a sensing module 114, arranged to sense electrical characteristics of the generation circuit, and adapted to detect moisture presence in the sanitization area based on electrical characteristics of the generation circuit or changes therein. Operation of the generator may optionally be adjusted depending upon the output of the sensing module. This may be done using an optional controller 26 for example, which may be arranged to receive an output from the sensing module 114 and which is operatively coupled with the generator 22. For example, the sanitization cycle or process may be controlled to cease dependent upon sensing a moisture level below a pre-defined threshold (dryness detection) and/or temperature level above a pre-defined threshold.

For example, if used in association with the optional steam mode, the steam mode cycle should end when (substantially) all steam is evaporated. This can be detected using the sensing module, and the steam sanitization mode ended when moisture level is below a threshold associated with steam evaporation.

Due to the differences in dielectric permittivity between air and water, depending upon the moisture level of the atmosphere inside the sanitization area 34 (the humidity), the detected voltage or current across the electrodes 52*a*, 52*b*, or within the circuit of the one or more coils 92 will vary. For example, an effective capacitance between the electrodes 52*a*, 52*b* will vary depending upon atmosphere moisture level, which is then detectable by the sensing module in the voltage or current of the generator circuit. In the example of FIG. 27, the sensing module 114 is detecting voltage changes, but it may alternatively be connected in series with the generator circuit and detect current. A look-up table or pre-defined function or algorithm may be stored locally within the sensing module 114 or controller 26 permitting sensed electrical characteristics (or changes therein) to be associated with particular moisture or humidity levels (or changes therein).

In this way, it can be detected when (substantially) all steam has evaporated. Additionally or alternatively, the sensing can be used to determine whether there is sufficient moisture left on the bristles or within the sanitization area to perform a sanitization mode. In some cases, this might be done after running the standard (non-steam) sanitization mode to determine whether there is enough residual moisture to perform the steam flash mode.

In addition, the dielectric permittivity of water varies with temperature. This is shown for example in FIG. 1 of the paper: Andrei Andryieuski et al., Water: Promising Opportunities For Tunable All-dielectric Electromagnetic Metamaterials. August 2015, Scientific Reports 5:13535.

These known relationships can be used to determine temperature of water within the sanitization area 132, or at least changes therein, based on an output from the sensing module 114 representative of sensed variations in current or voltage of the generation circuit. This can be used to control the power or duration of operation of the generator 22, for example to prevent overheat, or to detect when a certain threshold temperature has been reached, e.g. to detect the end of the heating part of the sanitization cycle (discussed above), and begin the temperature maintenance part.

Since moisture level and temperature change during the sanitization cycle (time), a reference lookup table or function may be used which associates different combinations of temperature and moisture level values with different predetermined sets of one or more measured electrical characteristics of the generation circuit. This can be determined experimentally in some examples from which factory calibration master curves and look-up tables are defined.

In accordance with one or more embodiments, a sensing module 114 may be provided arranged to sense electrical characteristics of the generation circuit, and wherein an output of the sensing module is adapted to detect placement of an EM shield unit 62 (as discussed above) in a deployed configuration relative to the sanitization area 34, based on the electrical characteristics. Thus, the emitter arrangement is used to sense correct placement of a shield unit over the sanitization area 34 (e.g. a portion of the CTP 14). In preferred examples, the shield unit may comprise EM reflective surface portions or elements, as in various examples discussed above.

When the cap is correctly placed, due to the EM field or radiation blocking or reflection action, the EM field characteristics inside the sanitization area will change compared to when the cap is not correctly placed. This is detectable by the sensing module 114 in changed voltage or current in the generation circuit. Thus, placement of the cap can be detected.

Figure 28:
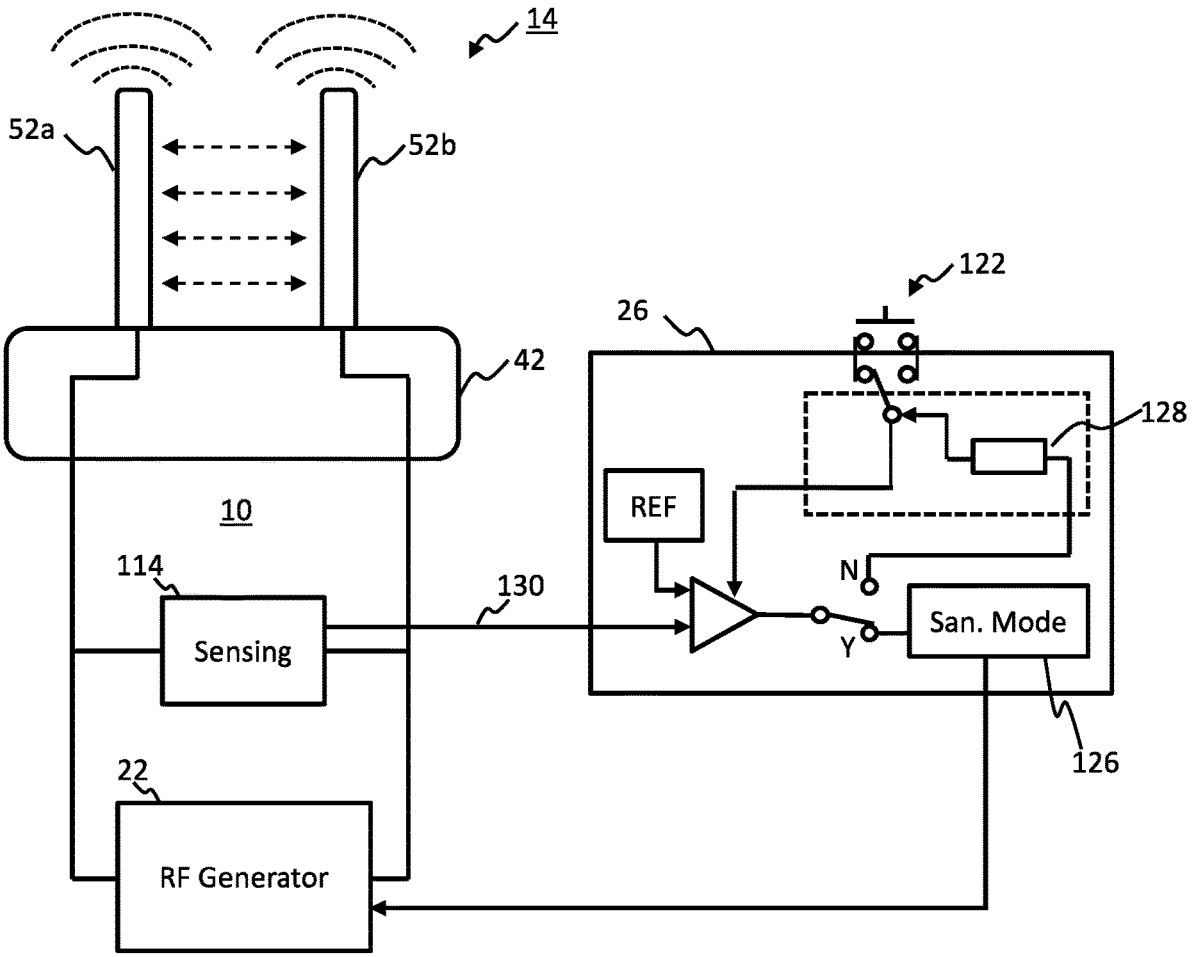
FIG. 28 illustrates an EM generation circuit with means for sensing placement of an EM shield over an emitter arrangement.

An example circuit arrangement for implementing this embodiment is shown in FIG. 28.

The placement sensing may be triggered responsive to a control command from a user control element, e.g. pressing of a sanitization button 122 by a user. As shown in FIG. 28, the sensing module 114 outputs a sensing signal 130 indicative of sensed signal characteristics of the generation circuit (voltage in FIG. 28, but current may be sensed in alternative arrangements). This sensing signal 130 is compared with a reference signal, REF, indicative of presence (or absence) of the shield unit. Depending upon the result, the control electronics (for example as implemented by a controller 26) either activates the sanitization mode 126 "Y") or resets the system 128 ("N") and enters an inactive sleep mode. Optionally, a time-out mechanism is implemented, whereby if no sensing signal from the sensing module 114 is received within a pre-defined time window, the controller automatically switches off the sanitization mode.

In accordance with each of the above sensing options, the sensing function may be performed based on monitoring electrical characteristics of the electrical circuit comprising the emitter arrangement 24 (e.g. a first 52*a* and second 52*b* electrode or at least one loop coil 19). For example, the signal generator 22 may be electrically connected to a first 52*a* and second 52*b* electrode and arranged to apply an alternating drive signal across the electrodes. The circuit comprising the generator 22, and the first and second electrodes forms an RF generation circuit. Sensing is then based on monitoring electrical characteristics of the generation circuit such as complex impedance or inductance. The change in capacitance may be measured based on sensing a voltage change over the electrode pair formed of a first electrode and second electrode for example. A current change can also be detected and used. The current and/or voltage may be directly used as the sensed electrical characteristic.

It is noted that although in the examples of FIGS. 27 and 28, the sensing module is shown as a separate physical unit, the module may simply be a functional module. Its function may be performed by circuitry or processing components comprised by another unit, for example the controller 26.

In in accordance with one or more embodiments, the oral care device may comprise a sensory output element, such as one or more lights visible at an exterior surface of the device, or an acoustic or haptic feedback element. Optionally, following completion of the sanitization mode, a controller may provide sensory feedback to the user using the output elements, e.g. triggering an alert sound, a vibration, or illumination of one or more lights.

Examples in accordance with a further aspect of the invention provide a method for sanitizing at least a cleaning or treatment portion 14 of an oral care device 12, wherein the cleaning or treatment portion is for being received in an oral cavity of a user for performing a cleaning or treatment function.

The method comprises generating signals using a signal generator 22 for causing a connected emitter arrangement 24, comprising one or more conductive elements, to generate a radiofrequency and/or microwave frequency electromagnetic field or radiation in a sanitization area 34 around the emitter arrangement, the EM field or radiation suitable for causing heating of water or water-containing fluid present on any exposed surfaces of the cleaning or treatment portion located in the sanitization area.

In accordance with one or more advantageous embodiments, a controller 26 may be configured to implement a cleaning protocol comprising two or more of the following ordered steps.

Step 1: Implement mechanical cleaning of a cleaning or treatment portion 14 of an oral care device based on activation of a mechanical actuator comprised by the device and arranged to couple a mechanical movement to the oral cleaning or treatment portion (CTP). For example, this may comprise activating an oscillation mechanism or drivetrain mechanism of a power toothbrush or of a cleaning mouthpiece unit. This can be done with the cleaning or treatment portion submerged in water, with or without active ingredients added. This mechanical cleaning step may remove larger particles of dirt or debris, such toothpaste or food debris.

Step 2: Activate a standard sanitization mode in which EM radiation is generated for heating water on or around the CTP to at least 70° C. and maintaining said temperature for at least 10 seconds. This may be performed with or without a shield unit in accordance with any of the examples discussed above.

Step 3: Implement a disinfection/sterilization type sanitization mode comprising generating electromagnetic radiation for heating water on or around the CTP 14 so as to turn it to steam. This may be done with a cover unit deployed over the sanitization area (e.g. over a bristle field of a brush head of a toothbrush) for at least partially retaining heat within the sanitization area, and the cover unit having a steam pressure relief hole.

For optimal effectiveness, these three different steps ('Cleaning-sanitization-sterilization') may be implemented in sequence as part of a defined cleaning control program or protocol. Performance of steps two and/or three may be made contingent on sensed atmospheric conditions in the sanitization area, e.g. based on sensing temperature and/or moisture level as discussed above.

Optionally, step 1 and step 2 may be performed simultaneously. For example, the CTP may be submerged in water and the mechanical actuator triggered to induce mechanical cleaning. Simultaneously, the generator 22 can be controlled to generate the electromagnetic field or radiation for performing sanitization. Since the CTP is in contact with water, this water can be heated to perform the sanitization.

Figure 29:
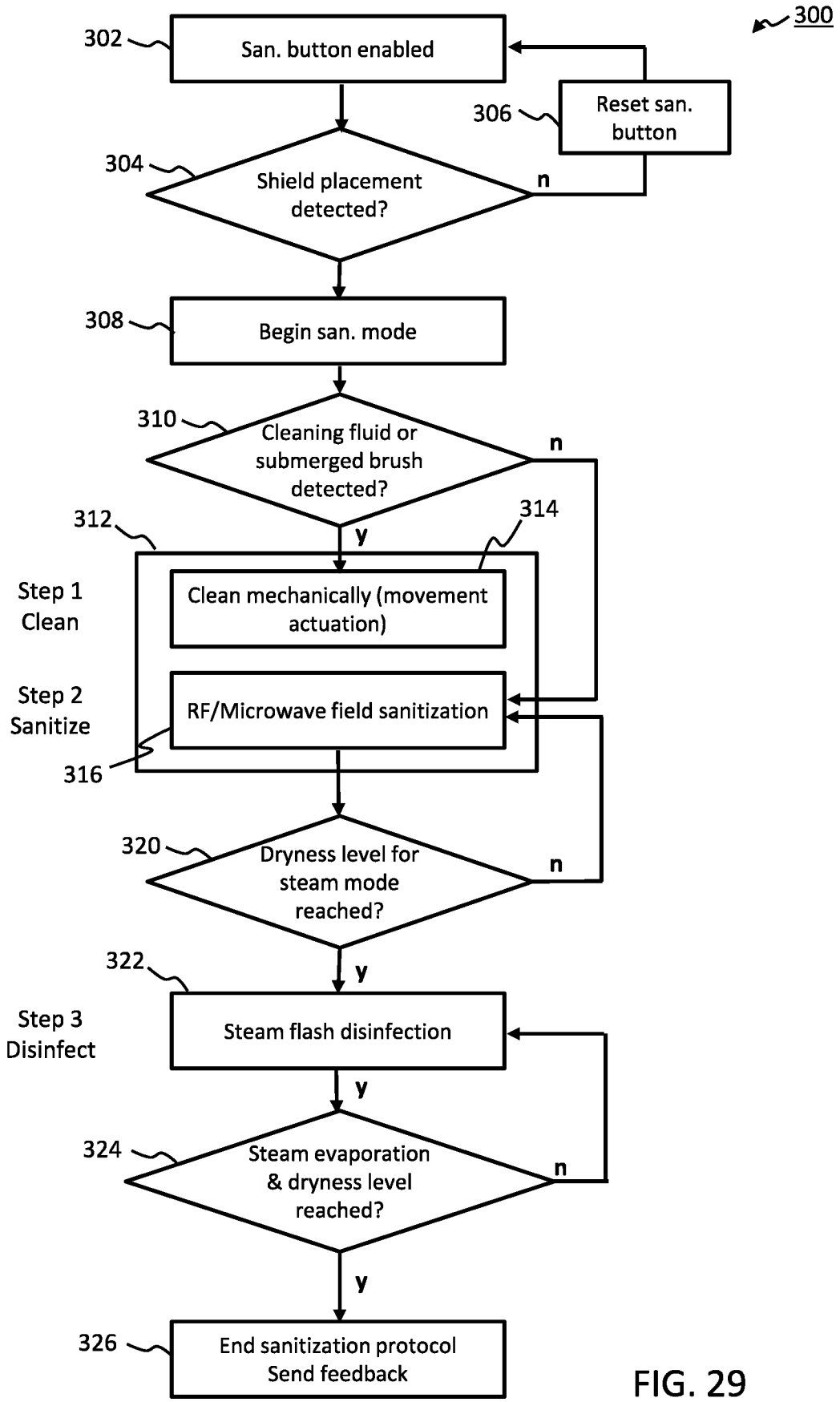
FIG. 29 outlines one example workflow for operation of a sanitization protocol.

An example control workflow for a cleaning protocol is outlined in FIG. 29. Each of the steps has individually been described in detail above, and thus these details will not be repeated here. The method is described in relation to a powered toothbrush, but can be applied in similar fashion to any example oral care device 12 with any example cleaning or treatment portion 14.

The protocol begins with a user pressing 302 a sanitization button on an oral care device. Optionally, the controller may detect 304 whether a shield unit 62 is correctly placed based on a sensing module monitoring electrical characteristics of the generator circuit. If the shield has not been correctly placed the sanitization button may be reset 306. If the shield is detected to be correctly placed, the sanitization mode may be begun 308.

A controller may detect 310 whether a head of the brush is submerged within water based on sensing a moisture level, based on monitoring electrical characteristics of the generator circuit. If submergence is detected, steps 1 and 2 of the cleaning protocol discussed above are performed. This involves performing mechanical cleaning 314 through triggering the actuation mechanism of the oral care device and either simultaneously or subsequently performing a sanitization mode 316 in which microwave or radiofrequency electromagnetic radiation is generated to heat the water to a sanitization level. A controller then detects whether a moisture level in the sanitization space is sufficiently low (e.g. the bristle field surfaces are sufficiently dry) for steam mode to be activated. If not, the sanitization mode 316 is continued until the dryness level is reached. Once the dryness level is reached, the steam flash mode 322 for disinfection is activated. A controller further senses 324 whether substantially all of the water has been evaporated, based on sensing a moisture level in the sterilization space, based on monitoring electrical characteristics of the generator circuit. If the required dryness level has not been reached, the steam flash mode is continued 322. Otherwise, the sanitization protocol is ended 326 and sensory feedback is preferably generated to communicate this to a user.

Embodiments according to the present invention provide advantages over known sanitization approaches for oral care devices.

One advantage resides in improved efficacy of sanitization, compared to UV sanitization which cannot penetrate to all surfaces of a cleaning or treatment portion of an oral cleaning device.

A further advantage resides in shorter sanitization times, for example typically less than 30 seconds.

A further advantage resides in low power/energy requirements (e.g. 10-20 W, and less than 100-200 J for a cleaning cycle).

As discussed above, embodiments make use of a controller. The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable, such that the one or more programs stored thereon can be loaded into a processor or controller.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

A single processor or other unit may fulfill the functions of several items recited in the claims.

Measures recited in mutually different dependent claims can be advantageously combined.

If the term "adapted to" is used in the claims or description, it is noted the term "adapted to" is intended to be equivalent to the term "configured to".

Any reference signs in the claims should not be construed as limiting the scope.

The invention claimed is:

1. An oral care device operably coupleable to a cleaning or treatment portion, comprising:

a signal generator operable to generate radiofrequency and/or microwave frequency electromagnetic radiation when said generator is operatively coupled to an emitter arrangement and selectively operable in an oral cleaning or treatment mode to generate signals for causing the emitter arrangement to generate electromagnetic radiation for performing an oral cleaning or treatment function, wherein the signal generator is further selectively operable in a sanitization mode in which the signal generator is adapted to generate signals for causing the emitter arrangement to generate RF and/or microwave frequency electromagnetic radiation in a sanitization area around the emitter arrangement, the radiation suitable for causing heating to a temperature of at least 50° C. of water in contact with an exposed surface of the cleaning or treatment portion located in the sanitization area, wherein in the cleaning or treatment mode, the signal generator is adapted to generate signals for causing the emitter arrangement to generate electromagnetic radiation having a lower electromagnetic frequency than in the sanitization mode.

2. The oral care device of claim 1, wherein, in the sanitization mode, the generator is adapted to generate drive signals for causing the emitter arrangement to generate electromagnetic radiation, the drive signals having an average power of at least 10-20 W, and the signals being generated for a period of at least 10-20 seconds.

3. The oral care device of claim 1, wherein the oral care device further comprises a mechanical actuator for providing a source of mechanical movement, and arranged for coupling said movement to the cleaning or treatment portion in use, and wherein the mechanical actuator is active during the sanitization mode.

4. The oral care device of claim 1, wherein the generator and emitter arrangement, when coupled, form a generation circuit, and wherein the oral care device further comprises a sensing module, arranged to sense electrical characteristics of the generation circuit, and adapted to detect:

a moisture presence in the sanitization area based on electrical characteristics of the generation circuit; and/or a temperature within the sanitization area based on electrical characteristics of the generation circuit.

5. The oral care device as claimed in claim 1, wherein the radiation is suitable for causing heating to a temperature of at least 70° C.

6. An oral care system comprising:

an oral care device operably coupleable to a cleaning or treatment portion;

a signal generator operable to generate radiofrequency and/or microwave frequency electromagnetic radiation when said generator is operatively coupled to an emitter arrangement, and selectively operable in an oral cleaning or treatment mode to generate signals for causing the emitter arrangement to generate electromagnetic radiation for performing an oral cleaning or treatment function, wherein the signal generator is further selectively operable in a sanitization mode in which the signal generator is adapted to generate signals for causing the emitter arrangement to generate RF and/or microwave frequency electromagnetic radiation in a sanitization area around the emitter arrangement, the radiation suitable for causing heating to a temperature of at least 50° C. of water in contact with an exposed surface of the cleaning or treatment portion located in the sanitization area; and an electromagnetic shield unit configurable in a deployed configuration in which the electromagnetic shield unit is arranged in a defined spatial relationship with respect to the sanitization area around the emitter arrangement and is adapted to at least partially inhibit escape of electromagnetic energy from the sanitization area.

7. The oral care system of claim 6, wherein the shield unit comprises one or more electromagnetic-reflective elements or surfaces adapted to at least partially reflect the electromagnetic radiation generated by the emitter arrangement in the sanitization mode, for use in at least partially containing said electromagnetic radiation in the sanitization area when the shield unit is placed in the deployed configuration.

8. The oral care system of claim 6, wherein the oral care system comprises the cleaning or treatment portion and the cleaning or treatment portion comprises the emitter arrangement; and wherein the shield unit comprises a cover unit defining an internal cavity, and arranged in the deployed configuration to fit over at least a section of the cleaning or treatment portion with said section at least partially received in the cavity.

9. The oral care system of claim 6, wherein the oral care system comprises the cleaning or treatment portion and the cleaning or treatment portion comprises the emitter arrangement; and wherein the shield unit is configurable in a deployed configuration and a non-deployed configuration, and wherein the shield unit is physically separable from the oral care device to place it in the non-deployed configuration, and is adapted to be mechanically mountable or connectable to the oral care device to place it in the deployed configuration.

10. The oral care system of claim 6, wherein the oral care system comprises the cleaning or treatment portion and the cleaning or treatment portion comprises the emitter arrangement; and the shield unit is adapted to be mechanically moveable between a non-deployed configuration and a deployed configuration, the shield unit being mechanically connected or mounted to the oral care device in both positions, and wherein, in the deployed configuration, the shield unit is arranged at least partially covering or facing the sanitization area, and, in the non-deployed configuration, the shield unit is in a different position.

11. The oral care system of claim 6, wherein the generator and emitter arrangement form a generation circuit, and wherein the oral care device further comprises a sensing module, arranged to sense electrical characteristics of the generation circuit, and wherein the shield unit comprises one or more electromagnetic-reflective surfaces or elements adapted to at least partially reflect the electromagnetic radiation generated by emitter arrangement, and wherein the sensing module is adapted to detect placement of the shield unit in the deployed configuration based on the electrical characteristics.

12. The oral care system as claimed in claim 6, wherein the radiation is suitable for causing heating to a temperature of at least 70° C.

13. An oral care device operably coupleable to a cleaning or treatment portion, comprising:

a signal generator operable to generate radiofrequency and/or microwave frequency electromagnetic radiation when said generator is operatively coupled to an emitter arrangement, and selectively operable in an oral cleaning or treatment mode to generate signals for causing the emitter arrangement to generate electromagnetic radiation for performing an oral cleaning or treatment function, wherein the signal generator is further selectively operable in a sanitization mode in which the signal generator is adapted to generate signals for causing the emitter arrangement to generate RF and/or microwave frequency electromagnetic radiation in a sanitization area around the emitter arrangement, the radiation suitable for causing heating to a temperature of at least 50° C. of water in contact with an exposed surface of the cleaning or treatment portion located in the sanitization area, and a cover unit being configurable in a deployed configuration in which the cover unit is arranged to enclose or surround the sanitization area to at least partially restrict escape of heat, for encouraging steam generation in the sanitization area, and having a pressure relief opening to permit escape of steam.

14. An oral care device operably coupleable to a cleaning or treatment portion, comprising:

a signal generator operable to generate radiofrequency and/or microwave frequency electromagnetic radiation when said generator is operatively coupled to an emitter arrangement, and selectively operable in an oral cleaning or treatment mode to generate signals for causing the emitter arrangement to generate electromagnetic radiation for performing an oral cleaning or treatment function, wherein the signal generator is further selectively operable in a sanitization mode in which the signal generator is adapted to generate signals for causing the emitter arrangement to generate RF and/or microwave frequency electromagnetic radiation in a sanitization area around the emitter arrangement, the radiation suitable for causing heating to a temperature of at least 50° C. of water in contact with an exposed surface of the cleaning or treatment portion located in the sanitization area, wherein the generator and emitter arrangement, when coupled, form a generation circuit, and wherein the oral care device further comprises a sensing module, arranged to sense electrical characteristics of the generation circuit, and adapted to detect a temperature within the sanitization area based on electrical characteristics of the generation circuit, and wherein the oral care device further comprises a controller adapted to implement a sanitization control program comprising heating of fluid in the sanitization area to a temperature of at least 50-70° C., and maintaining the fluid at said temperature for at least 10-20 seconds, wherein the controller is arranged to receive a temperature sensing signal from the sensing module for use in implementing the control program.

* * * * *